US005936598A

United States Patent [19]

Hayama et al.

[11] Patent Number: 5,936,598

[45] Date of Patent: Aug. 10, 1999

[54] CAPACITIVE LOAD DRIVE CIRCUIT AND METHOD

[75] Inventors: Hiroshi Hayama; Takashi Nose, both of Tokyo, Japan

[73] Assignee: NEC Corporation, Japan

[21] Appl. No.: 08/813,548

[22] Filed: Mar. 7, 1997

[30] Foreign Application Priority Data

Mar. 8, 1996 [JP] Japan ..... 8-080794
Jun. 12, 1996 [JP] Japan ..... 8-342769

[51] Int. Cl.[6] ..... G09G 3/30

[52] U.S. Cl. ..... 345/76; 345/87; 345/212

[58] Field of Search ..... 345/70, 76, 79, 345/87, 92, 94, 99, 211, 212

[56] References Cited

U.S. PATENT DOCUMENTS 5,786,794 7/1998 Kishi et al. ..... 345/60
5,847,516 12/1998 Kishita et al. ..... 345/76

FOREIGN PATENT DOCUMENTS 6274125 9/1994 Japan .

OTHER PUBLICATIONS

Energy Recovery Sustain Circuit for the AC Plasma Display, Larry F. Weber and Mark B. Wood, University of Illinois at Urbana–Champaign, Urbana,IL, SID 87 Digest pp. 92–95.

*Primary Examiner*—Matthew Luu
*Attorney, Agent, or Firm*—Ostrolenk, Faber, Gerb & Soffen

[57] ABSTRACT

A drive circuit is provided which enables low-power-consumption drive of even a low-voltage capacitive load. The drive circuit used has a capacitance, one end of which is grounded and other end of which is connected in series via an analog switching circuit to one end of an inductive element, thereby forming a series LC resonant circuit, the other end of the inductive element being connected to one end of a capacitive load, the other end of which is grounded, a PMOS switching element being connected between the ungrounded end of the above-noted load capacitance and a positive drive voltage supply and an NMOS switching element being connected between the ungrounded end of the load capacitance and a ground terminal.

27 Claims, 18 Drawing Sheets

Fig. 4A
(a) SIGNAL WAVEFORMS WHEN USING LINE-SEQUENTIAL DRIVE
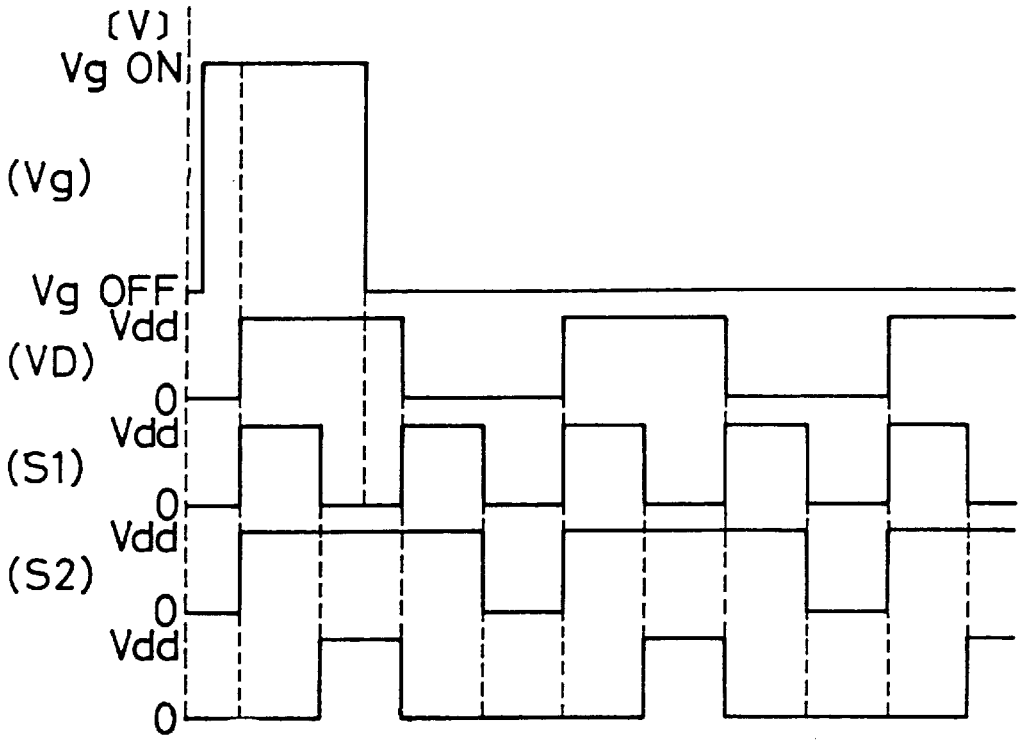
(b) SIGNAL WAVEFORMS WHEN USING INTERLACED DRIVE
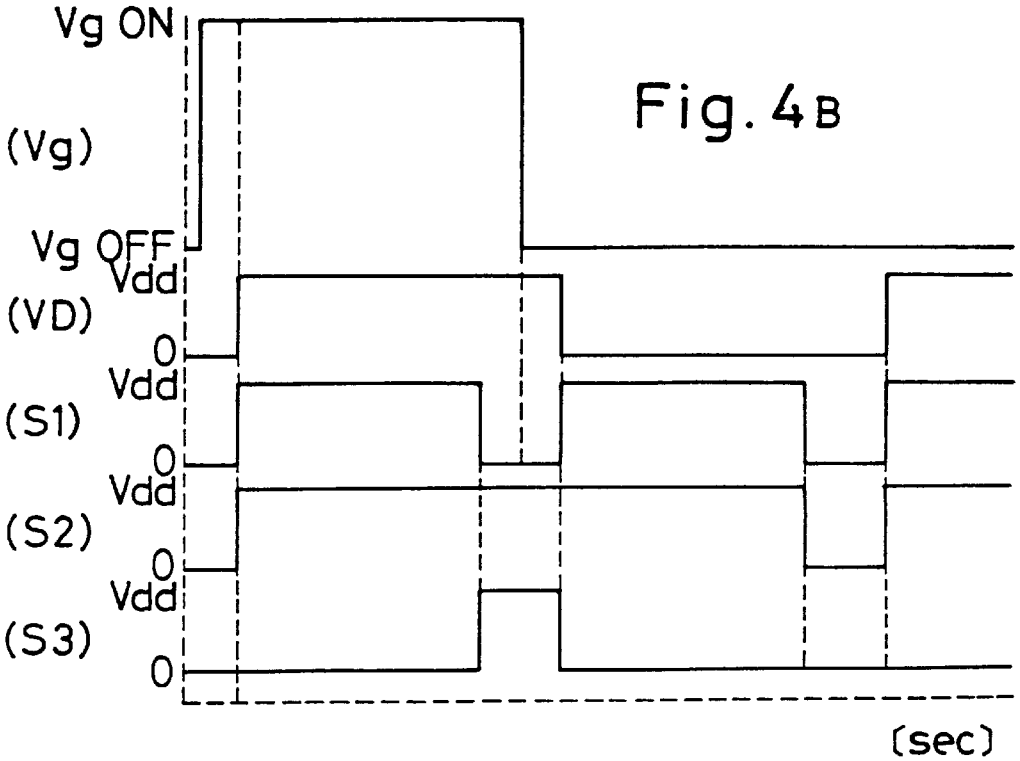
Fig. 4B

CAPACITIVE LOAD DRIVE CIRCUIT AND METHOD

BACKGROUND OF THE INVENTION

1. Field of the Invention

The present invention relates to a drive circuit, and more specifically to a drive circuit that is suitable for an application in which a capacitive load is driven with a relatively low voltage, such as in a low-voltage drive circuit for the opposing electrodes or signal lines of a liquid crystal display.

2. Description of Related Art

There have descriptions in the literature regarding a low-power-consumption drive circuit and driving method for driving a capacitive load such as the signal line of a flat display, there have been description such as, for example, the technical description of an AC-driven plasma display drive circuit (pp. 92–95 of Vol. 18 of the 1987 Society for Information Display International Symposium Digest).

FIG. 18 shows the drive circuit which is described in the above-noted paper. Referring to FIG. 18, in a prior art plasma display drive circuit, the connection node N1 between the switching elements 45 and 46, one end each of which is connective to the load capacitance 7, and the other end of each is connected to the power supply Vdd and to ground, respectively, is connected to one end of the coil 41, the other end of which is connected in common to both the cathode of the diode 47 and the anode of the diode 48, the anode of the diode 47 and the cathode of the diode 48 being connected, via the switching elements 43 and 44, respectively, to one end of the capacitance 42, the other end of which is grounded, the driving circuit as mentioned above driving the load capacitance 7.

The switching elements 43 through 46 are formed by analog switching circuits. In the above-cited paper, while the only configuration for the switching element is an NMOS transistor, to the base of which the substrate is shorted, to include in FIG. 18 wide range of element configurations, this is shown as a general analog switching circuit. In FIG. 18, diode 47 and diode 48 are often included in an NMOS transistor, to the source of which the substrate is shorted. The same type of configuration as in the drive circuit shown in FIG. 18 is disclosed also in, for example, the Japanese Unexamined Patent Publication (KOKAI) No. 6-274125.

In the prior art plasma display drive circuit which is shown in FIG. 18, the example is that in which the value of the drive voltage (Vdd) is a high voltage such as 100 V. However, in a drive circuit of the past such as shown in FIG. 18, in the ease of a relatively low drive voltage, such as when the drive voltage is less than about 5 V, there is a problem in that the power consumption becomes large.

With regard to the above-noted problem, we will first describe the problem as it relates to the operation of the prior art drive circuit which is shown in FIG. 18. In the drive circuit which is shown in FIG. 18, the terminal voltage of the load capacitance 7 is periodically driven to 0 V and to Vdd volts with low power, such as 5 V or the like. The process occurs as follows.

(1) With the switching elements 43, 45, and 46 all in OFF condition, the switching element 44 is turned ON for a period of time that is approximately ½ of the period of the resonant frequency of the series LC resonant circuit form by the coil 41, the capacitance 42, and the load capacitance 7, the electrical charge which is stored in the load capacitance 7 being thereby transferred to the coil 41 (first time period).

(2) With the switching elements 43, 44, and 45 all in OFF condition, the switching element 46 is turned ON (second time period).

(3) With the switching elements 44, 45, and 46 all in OFF condition, the switching element 43 is turned ON for a period of time that is approximately ½ of the period of resonance period, the electrical charge that is stored in the coil 41 being thereby transferred to the load capacitance 7 (third time period).

(4) With the switching elements 43, 44, and 46 all in OFF condition, the switching element 45 is turned ON (fourth time period).

The above-noted process steps (1) through (4) are repeated in sequence.

In the above-noted first time period, the electrical charge stored in the load capacitance 7 by the drive voltage Vdd is transferred to the coil 41 using the series LC resonance phenomenon. In the above-noted second time period, the terminal voltage of the load capacitance 7 is maintained at 0 V.

In the above-noted third time period, the electrical charge which was transferred to the coil 41 is returned to the load capacitance 7, the terminal voltage of which rises to a voltage of approximately Vdd. Then, in the fourth time period, the terminal voltage of the load capacitance 7 is set to and held at the voltage Vdd.

In this driving method, because electrical energy is only dissipated in the parasitic resistance components of the coil, switching elements, and diodes, it is possible to drive the terminal voltage of the load capacitance 7 periodically to 0 V and Vdd.

As is indicated in the above-cited reference as well, in a drive circuit of the past such as shown in FIG. 18, in the case in which the drive voltage is, for example, a value of Vdd such as 100 V, it is possible to perform low-power-consumption drive.

If, however, the drive voltage Vdd is a low voltage of 5 V or lower, it is not possible to perform low-power-consumption drive with the prior art drive circuit shown in FIG. 18.

This reason for this is that, in the drive circuit which is shown in FIG. 18, the forward voltage (Vf) of the diodes 47 and 48, which has a value of approximately 0.6 to 1 V, is non-negligible with respect to a drive voltage of 5 V.

In the case of diode 48, because when the cathode potential thereof rises to (Vdd−Vf), it is switched off, when the terminal voltage of the load capacitance 7 drops, it drops only to the forward voltage Vf of the diode but does not drop down to 0 V.

In the case of diode 47 as well, because when the cathode potential thereof rises to (Vdd−Vf), it is switched off, when the terminal voltage of the load capacitance 7 rises as well, because it only rises to (Vdd−Vf), the energy that must be supplied from the Vdd power supply is large.

Thus, in the case of a low-voltage drive liquid crystal display or the like, it is difficult with a prior art drive circuit such as shown in FIG. 18 to perform low-power-consumption drive.

Therefore, the present invention was made in consideration of the above-noted situation, and has as an object the provision of a drive circuit which is capable of low-power-consumption operation, even in the case of a capacitive load with a relatively low drive voltage.

SUMMARY OF THE INVENTION

To achieve the above-described object, the present invention has the following described constitution.

(1) One aspect of the present invention is a driving circuit which has a capacitance, one end of which is grounded and other end of which is connected in series via an analog switching circuit to one end of an inductive element, the other end of the inductive element being connected to one end of a capacitive load, the other end of which is grounded, thereby forming a series LC resonant circuit, a PMOS switching element being connected between the ungrounded end of the above-noted load capacitance and a positive drive voltage supply and an NMOS switching element being connected between the ungrounded end of the above-noted load capacitance and a ground terminal.

(2) The constitution of another aspect of the present invention is one having an inductive element, a driving circuit having an inductive element, one end of which is grounded and other end of which is connected in series via an analog switching circuit to one end of a load capacitance, the other end of which is grounded, thereby forming a series LC resonant circuit, further a PMOS switching element being connected between the ungrounded end of the above-noted load capacitance and a positive drive voltage supply and an NMOS switching element being connected between the ungrounded end of the above-noted load capacitance and a negative drive voltage supply.

(3) Yet another aspect of the present invention is a driving circuit one having a constitution as noted in (1) or (2) above, wherein the above-noted load capacitance is an active-matrix liquid crystal display panel, the opposing electrodes of this active-matrix liquid crystal display panel being connected to the above-noted ungrounded end of the load capacitance.

(4) Yet another aspect of the present invention is a driving circuit one having a constitution in which the construction of the above-noted active-matrix liquid crystal display panel has two electrode groups, which are formed by cutting a opposing electrode into a plurality of strip-like opposing electrodes, along the lines corresponding to a spaced lines formed among said pixel lines in parallelism with data bus lines and wherein the regions of the above-noted opposing electrodes between pixel electrodes located on a first substrate side and pixel electrodes in the data bus line direction being patterned in parallel with the above-noted data bus lines, and further every other line of the thus-patterned opposing electrodes being joined and set to the same potential to form a first electrode group, and a second electrode group being formed by joining every other patterned line of the opposing electrodes other than those of the above-noted first electrode group to set them to the same potential, two groups of drive circuits being formed, the above-noted capacitive load being a capacitance that is formed between the above-noted first electrode group and the above-noted first substrate, a first drive circuit group being formed which connects the above-noted first electrode group to the ungrounded end of the above-noted capacitive load, and the above-noted capacitive load being a capacitance that is formed between the above-noted second electrode group and the above-noted first substrate, a second drive circuit group being formed which connects the above-noted second electrode group to the ungrounded end of the above-noted capacitive load.

(5) Another constitution of the present invention is one in which the construction of the above-noted panel as noted in (4) above is such that an inductive element is series connected via an analog switching circuit to the above-noted first electrode group, this inductive element being connected in series with the above-noted second electrode group to form a series LC resonant circuit, a PMOS switching element being connected between the above-noted first electrode group and a positive drive voltage supply, an NMOS switching element being connected between the above-noted first electrode group and a ground terminal, a PMOS switching element being connected between the above-noted second electrode group and a positive drive voltage supply, and an NMOS switching element being connected between the above-noted second electrode group and a ground terminal. (6) In another aspect of the present invention, the present invention is driving method, which shall hereinafter be referred to as the scan line inversion driving method, in which, in the drive circuit described in (3) above, a signal waveform applied to an above-noted data bus line on the above-noted first substrate is driven so as to correspond to a pixel signal to be applied to the above-noted pixel electrode, and, in synchronization with the rising edge and falling edge of this signal waveform, four time periods are sequentially repeated, these time periods being a first time period in which, with both the above-noted NMOS switching element and above-noted PMOS switching element as noted in any of (1) to (4) above in OFF condition, the above-noted analog switching circuit is turned ON for a period of time that is approximately ½ the period of the resonant frequency of the LC series resonant circuit formed by the above-noted inductive element, capacitance, and active-matrix liquid crystal panel, thereby transferring the electrical charge that was stored in the opposing electrodes of the above-noted active-matrix liquid crystal panel to the above-noted inductive element, a second time period in which, with both the above-noted analog switching circuit and the above-noted PMOS switching element in OFF condition, the above-noted NMOS switching element is turned ON, a third time period during which, with both the above-noted NMOS switching element and the above-noted PMOS switching element in OFF condition the above-noted analog switching circuit is turned ON for a period of time that is approximately ½ the period of the resonant frequency, thereby transferring the electrical charge that was stored in the above-noted inductive element to the opposing electrodes of the above-noted active-matrix liquid crystal panel, and a fourth time period during which, with both the above-noted analog switching circuit and the above-noted NMOS switching element in OFF condition, the above-noted PMOS switching element is turned ON, the sequential repeating of the above-noted time periods performing AC voltage drive of the above-noted opposing electrodes, this performing sequential driving of the above-noted scan lines and above-noted data bus lines (hereinafter referred to as scan line inversion driving) so that the polarity of the voltage applied to the above-noted pixel electrode with respect to the above-noted electrode is reversed for each neighboring scan line.

(7) Another aspect of the present invention is a driving method as described in (6) above, in which scanning is performed of the scanning line signal applied to the above-noted scanning lines, skipping one or more lines on each scan, so that a plurality of frames forms one screen.

(8) Yet another aspect of the present invention is a driving method (which hereinafter shall be referred to as the dot reversal driving method), in which the first driving circuit and second driving circuit of the drive circuit noted in (4) above are driven, the above-noted first driving circuit and above-noted second drive circuit being driven in opposite phases by the driving method of (6) above, wherein in the above-noted first and second driving circuits, in synchronization with a rise of the signal waveform applied to the above-noted analog switching circuit, said signal waveform applied to the above-noted data bus line on the above-noted first substrate is driven in correspondence to a pixel signal to be applied to the above-noted pixel electrode, this performing sequential driving of the above-noted scan lines and above-noted data bus lines of the above-noted first substrate so that the polarity of the voltage applied to the above-noted pixel electrode with respect to the above-noted electrode is reversed for each neighboring pixel electrode, this driving being referred to as dot reversal driving.

(9) Yet another aspect of the present invention is a driving method in which the above-noted scan lines and above-noted data bus lines noted in (5) above are driven by the above-noted dot reversal driving method, the first electrode group potential and second electrode group potential being driven with opposite polarities, drive being performed so that the PMOS switching element which is connected between the first electrode group and the positive drive voltage supply and the NMOS switching element which is connected between the second electrode group and the ground terminal are ON simultaneously, and so that the NMOS switching element which is connected between the first electrode group and the ground terminal and the PMOS switching element which is connected between the second electrode group and the positive drive voltage supply are ON simultaneously.

DESCRIPTION OF THE DRAWINGS

FIGS. 4 (*a*) and 4(*b*) are drive signal waveform diagrams which illustrate the fourth embodiment of the present invention.

DETAILED DESCRIPTION OF THE PREFERRED EMBODIMENTS

Preferred embodiments of the present invention will be described, with reference being made to the relevant accompanying drawings.

Figure 1:
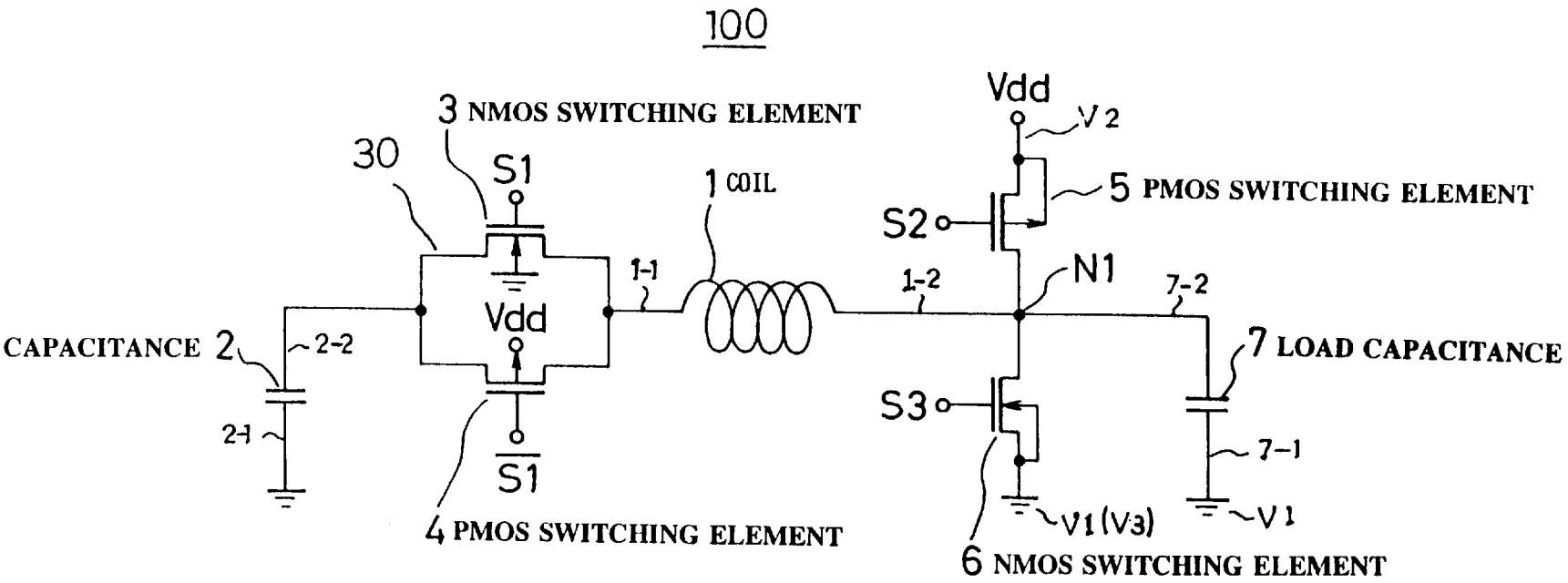
FIG. 1 is a circuit diagram of a drive circuit which illustrates the first embodiment of the present invention.

To attain the object of the present inventions a capacitive load drive circuit of the present invention basically has the following technical construction, for example, as shown in FIG. 1, a load capacitance drive circuit 100 comprising, a capacitance 2, an analog switching circuit 30, and an inductive element 1, a first end 2-1 of said capacitance 2 being grounded and a second end 2—2 of which being connected in series via said analog switching circuit 30 to a first end 1—1 of said inductive element 1, while a load capacitance 7, a first end 7-1 of which being connected to a first power source V1, is connected to a second end 1-2 of said inductive element 1 via a second end 7-2 of said load capacitance 7, thereby forming a series LC resonant circuit; and wherein a first and a second MOS switching elements 6, 5 being provided between said second end 7-2 of said load capacitance 7 and said first power source V1, and between said second end 7-2 of said load capacitance 7 and a second power source V2, which being different from said first power source V1, respectively.

Figure 2:
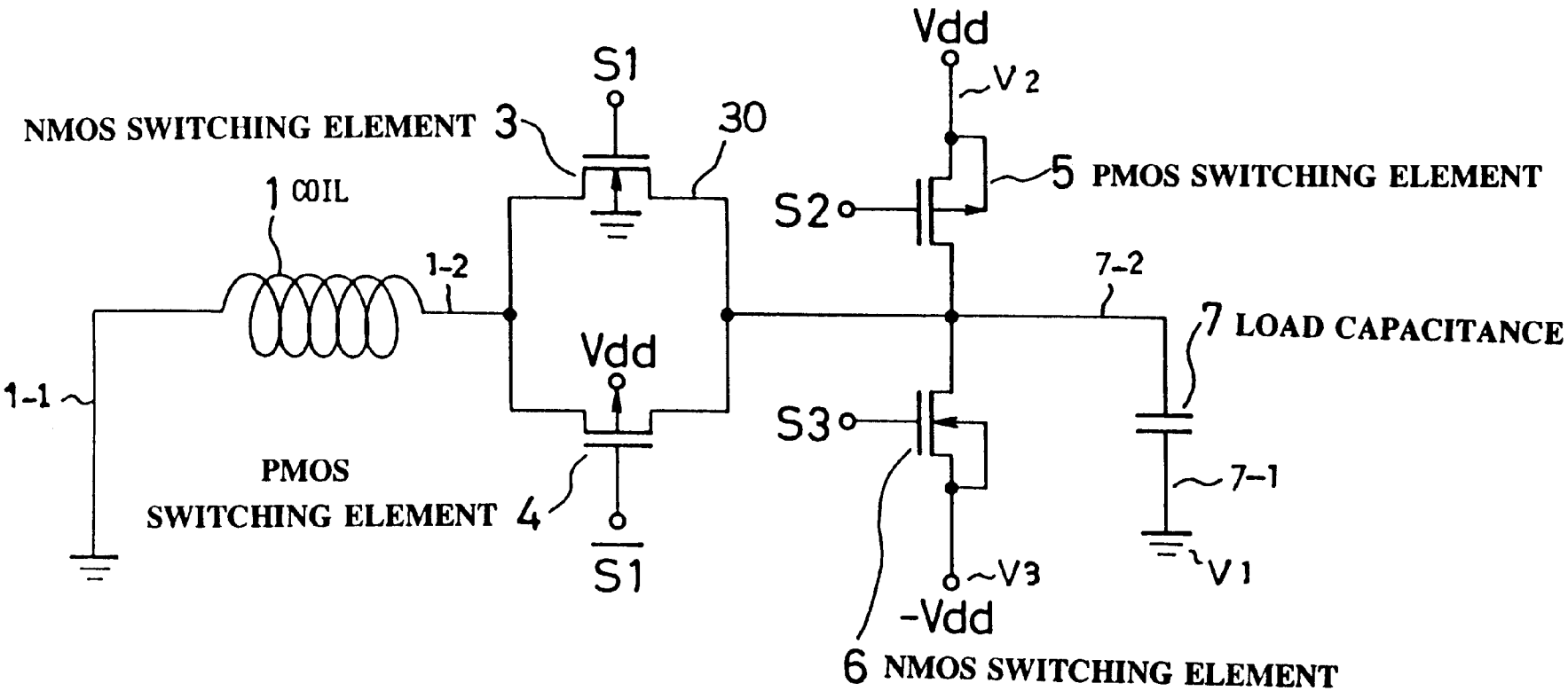
FIG. 2 is a circuit diagram of a drive circuit which illustrates the second embodiment of the present invention.

Another basic embodiment of the present invention, is as shown in FIG. 2, a load capacitance drive circuit 200 comprising, an inductive element 1, and an analog switching circuit 30, a first end 1—1 of said inductive element 1 being grounded and a second end 1-2 of which being connected in series via said analog switching circuit 30 to a second end 7-2 of a load capacitance 7, a first end 7-1 of which being connected to a first power source V1, thereby forming a series LC resonant circuit; and wherein a first and a second MOS switching elements 6, 5 being provided between said second end 7-2 of said load capacitance 7 and said first or third power source V1 or V3, and between said second end 7-2 of said load capacitance 7 and a second power source V2, which being different from said first or third power source V1 or V3, respectively.

As apparent from the above-mentioned embodiments of the present invention, the characteristic technical feature of the load capacitance drive circuit of the present invention is such that no diode device is used in series LC resonant circuit and thus the analog switching circuit 30 as used in the present invention is formed by electronic devices except for diodes.

Therefore, in the present invention any kinds of analog switching circuit not including diodes therein, can be used and thus a transfer gate circuit comprising MOSFET transistors or bi-polar transistors as shown in FIGS. 1 or 2 is one of a preferable analog switching circuit for the present invention.

In the present invention, since no diode is included in the load capacitance driving circuit, the voltage of the load capacitance can completely be driven between 0 V and a certain amount of positive voltage, Vdd, and accordingly, no positive current supply or negative current supply in required leading to drive the load capacitance with low voltage and less current consumption.

Figure 18:
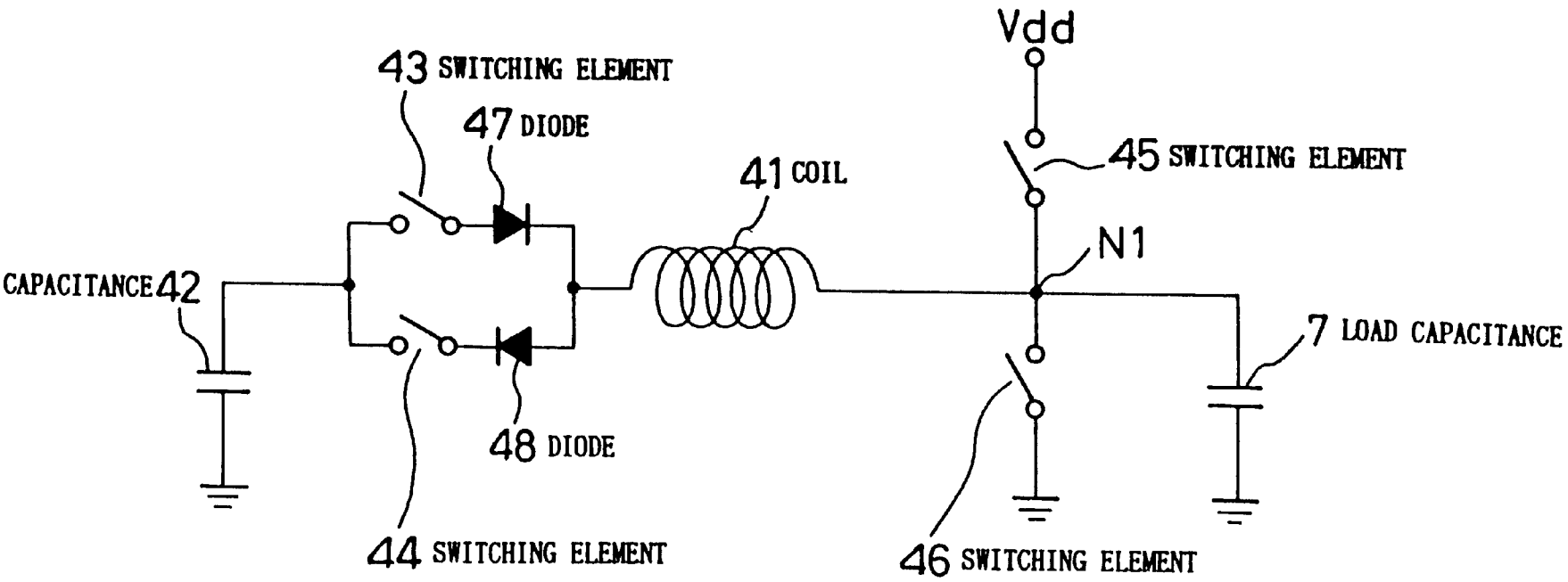
FIG. 18 is a drawing which shows a prior art drive circuit.

The most preferred embodiment of the present invention will be explained hereunder with reference to FIG. 1, as follows;

In a first embodiment of a drive circuit 100 according to the present invention, the diodes 47 and 48 have been removed from the prior art drive circuit which is shown in FIG. 18, an NMOS transistor 3 and a PMOS transistor 4 being connected in parallel as an analog switching circuit, to form a CMOS transfer gate circuit being used, the complimentary signals S1 and S1/bar being input to the respective transistors.

As shown in FIG. 1, the analog switching circuit 30, the inductive element 1 such as a coil or the like and the load capacitance 7 are serially connected to each other to form a series LC resonant circuit and a PMOS transistor 5 is connected as a switching element between the ungrounded end 7-2 of the load capacitance 7 and the positive drive voltage supply V2, for example, +Vdd, and an NMOS transistor 6 is connected as a switching element between the ungrounded end 7-2 of the load capacitance 7 and the ground terminal V1.

In the above-noted configuration, when the terminal voltage of the load capacitance 7 rises, it is possible for it to rise up to the drive voltage +Vdd. The terminal voltage of the load capacitance 7 is driven periodically between +Vdd and the ground potential, thereby greatly reducing the amount of electrical energy supplied from the power supply.

Next, turning to FIG. 2, which shows the second embodiment of a drive circuit 200 according to the present invention, it is apparent that, in contrast to the drive circuit 100 which is shown in FIG. 1, the capacitance 2 has been removed, and in contrast to the drive circuit of FIG. 1, in which the source of the NMOS transistor 6 is at ground potential, in this embodiment the source of the NMOS transistor 6 is connected to the negative drive voltage V3, for example, −Vdd.

While the basic operation of this circuit 200 is the same as that of the drive circuit 100 which is shown in FIG. 1, the terminal voltage of the load capacitance 7 is periodically driven between +Vdd and −Vdd, thereby greatly reducing the amount of electrical energy supplied from the power supply V2.

In the above-noted embodiment of the drive circuits 100 or 200 of the present invention, it is preferable that the PMOS transistor 5, the NMOS transistor 6, and the CMOS transfer gate 30 (analog switching element) be formed by TFT elements. In this case, can be fabricated together with thin-film transistors which are connected to the gate electrodes of the scan lines on, for example, a transparent substrate of a liquid crystal display, and which have drain and source electrodes connected to data bus lines and pixel electrodes.

In the load capacitance driving circuit of the present invention, the load capacitance 7 can be replaced with a known liquid crystal display panel or a known active-matrix liquid crystal display panel.

Further, in the present invention, the capacitance 2 also can be either one of a liquid crystal display panel or an active-matrix liquid crystal display panel.

Moreover, in the present invention, the capacitance 2 and the load capacitance 7 are both either one of a liquid crystal display panel or an active-matrix liquid crystal display panel.

In the above embodiment, when a liquid crystal display panel is used, its construction would be, for example, the one which comprises a first substrate provided with a plurality of pixel electrodes on a surface thereof and a second substrate provided with opposing electrodes on a surface thereof, both of said first and second substrates being parallely and closely arranged to each other with containing liquid crystal in a space formed therebetween, so that said liquid crystal of said panel can be driven by applying electric voltage across to said pixel electrodes and said opposing electrodes.

On the other hand, an active-matrix liquid crystal display panel which can be used in the present invention has such construction in that each one of said pixel electrodes provided on said first substrate is arranged on a portion in the vicinity of each intersection of scan lines and data bus lines both also being formed on a surface of said first substrate, while each of said scan lines being connected to a gate electrode of each one of a switching elements formed by thin-film field-effect transistors (TFTs), each of said data bus lines being connected to a source electrode of each one of said TFTs and each one of said pixel electrodes being connected to a drain electrode of each one of said TFTs.

Figure 3:
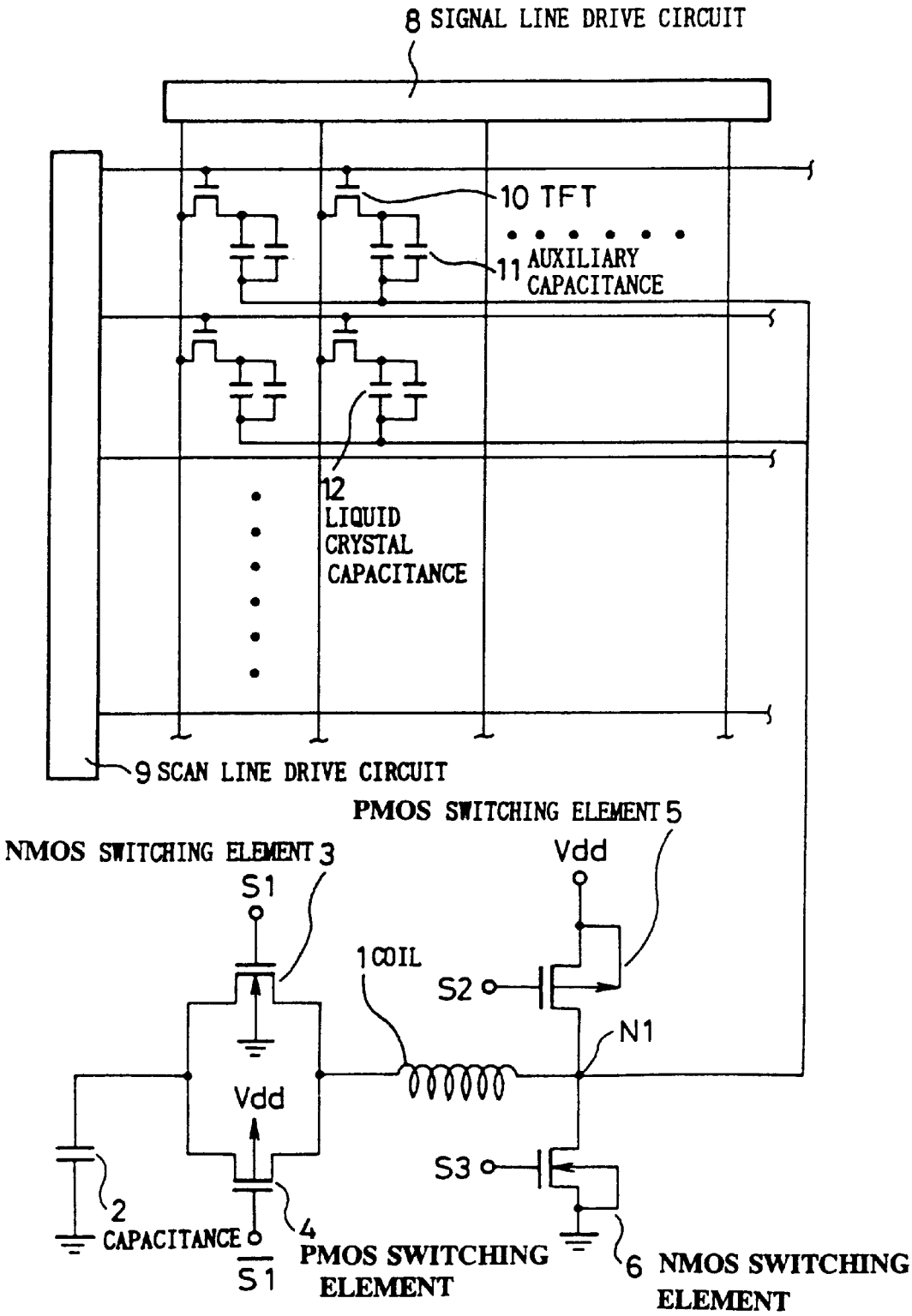
FIG. 3 is a circuit diagram of a drive circuit which illustrates the third embodiment of the present invention.

FIG. 3 shows another embodiment of a drive circuit according to the present invention. In the drive circuit which is shown in FIG. 3, the load capacitance 7 corresponding to the load capacitance 7 in FIG. 1 is an active-matrix liquid crystal panel, the opposing electrodes of this active-matrix liquid crystal panel being connected to the node N1, this circuit being used to drive these opposing electrodes.

FIG. 4(*a*) shows the drive signal waveforms. In this drawing, Vg is the scan line data bus waveform and VD is the signal line signal waveform, which are used to perform drive using the scan line reversal driving method.

In driving the above-noted opposing electrodes, as shown in FIG. 4(*a*), the data bus line signal waveform VD is driven in synchronization with the rising edge of the signal waveform S1 which is applied to gate electrodes of the NMOS switching element 3 and the PMOS switching element 4.

The data bus line signal waveform VD is driving so as to correspond to image signal to be applied to the pixel electrodes, the an scan lines and above-noted signal lines being driven using the scan reversal driving method. In performing AC drive of the opposing electrodes of an active-matrix liquid crystal panel, because it is necessary to complete the charging and discharging of the opposing electrodes within the writing time of the pixel electrode on the TFT substrates coil 1 is provided, so that ½ of the period of resonance during which the NMOS switching element 3 and the PMOS switching element 4 are on is made shorter than the pixel electrode writing time.

Next, another embodiment of the present invention will be described.

In the present invention, in the drive circuit which is shown in FIG. 3, the scanning signal which is applied to the scanning lines of an active-matrix liquid crystal panel is scanned every other line, so that a plurality of frames form one screen.

By using this type of driving method, the writing time of the pixel electrodes is made long, and the reversing period of the signal that is applied to the data bus lines and the opposing electrodes is also made long.

In performing AC drive of the opposing electrodes of an active-matrix liquid crystal panel, it is necessary to perform the charging and discharging of the opposing electrodes within the writing time of the pixel electrodes on the TFT substrate.

In an active-matrix liquid crystal panel, opposing electrodes are formed by covering the entire surface with indium-tin-oxide (hereinafter referred to as ITO) or the like, and in the cases for example, in which an electrical charge is to be supplied from the four corners of an opposing electrode, when the potential of the opposing electrode of the liquid crystal panel is set to the voltage Vdd, in supplying an electrical charge at the center part of the liquid crystal panel, the time is ½ of the period of resonance and the drive voltage supply Vdd, and a delay time because of an RC delay related to the parasitic resistance of the opposing electrode.

In a high-capacity panel such as for a large-screen or for a high-precision display, the lengthening of the period of resonance and the RC time delay cause a further increase in the delay time. If the inductance of the coil 1 shown in FIG. 3 is made large, the peak voltage at the LC resonance point increases, making it possible to reduce the electrical energy supplied from Vdd.

However, because it is necessary to charge and discharge the opposing electrode within the write time of the pixel electrode, there is a limit to the increase in the inductance of the coil 1.

FIG. 4 shows a form of this embodiment of the present invention, with FIG. 4(*a*) showing the signal waveforms in the case of using the prior at method of sequentially scanned drive, and FIG. 4(*b*) showing the signal waveforms in the case of using interlaced drive.

As shown in FIG. 4(*b*), by using interlaced drive, compared to the case of using sequentially scanned drive, the length of the writing time of the pixel electrode is approximately doubled, and the reversal period of the signal waveforms that are applied to the data bus lines and opposing electrodes is reduced by more than half.

By making the writing time long, because the time during which a series LC resonant circuit is formed becomes long, it is possible to make the inductance of the coil I larger, this increasing the voltage peak at the LC resonance point and reducing the amount of energy supplied from the Vdd power supply. By using a drive method which is an embodiment of the present invention as shown in FIG. 4(*b*), it is possible to perform high-efficiency low-power-consumption drive.

Figure 5:
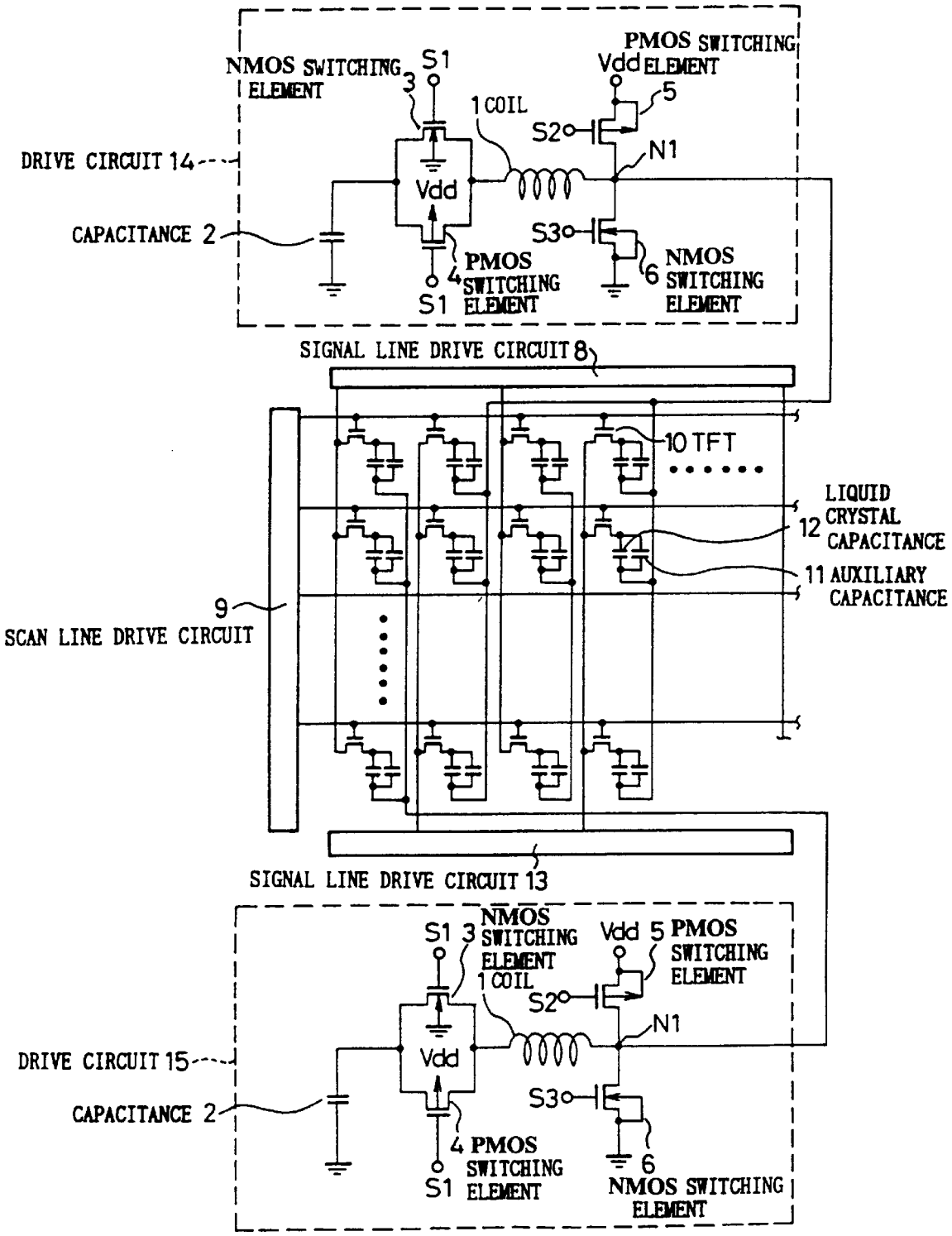
FIG. 5 is a circuit diagram of a drive circuit which illustrates the fifth embodiment of the present invention.
Figure 6:
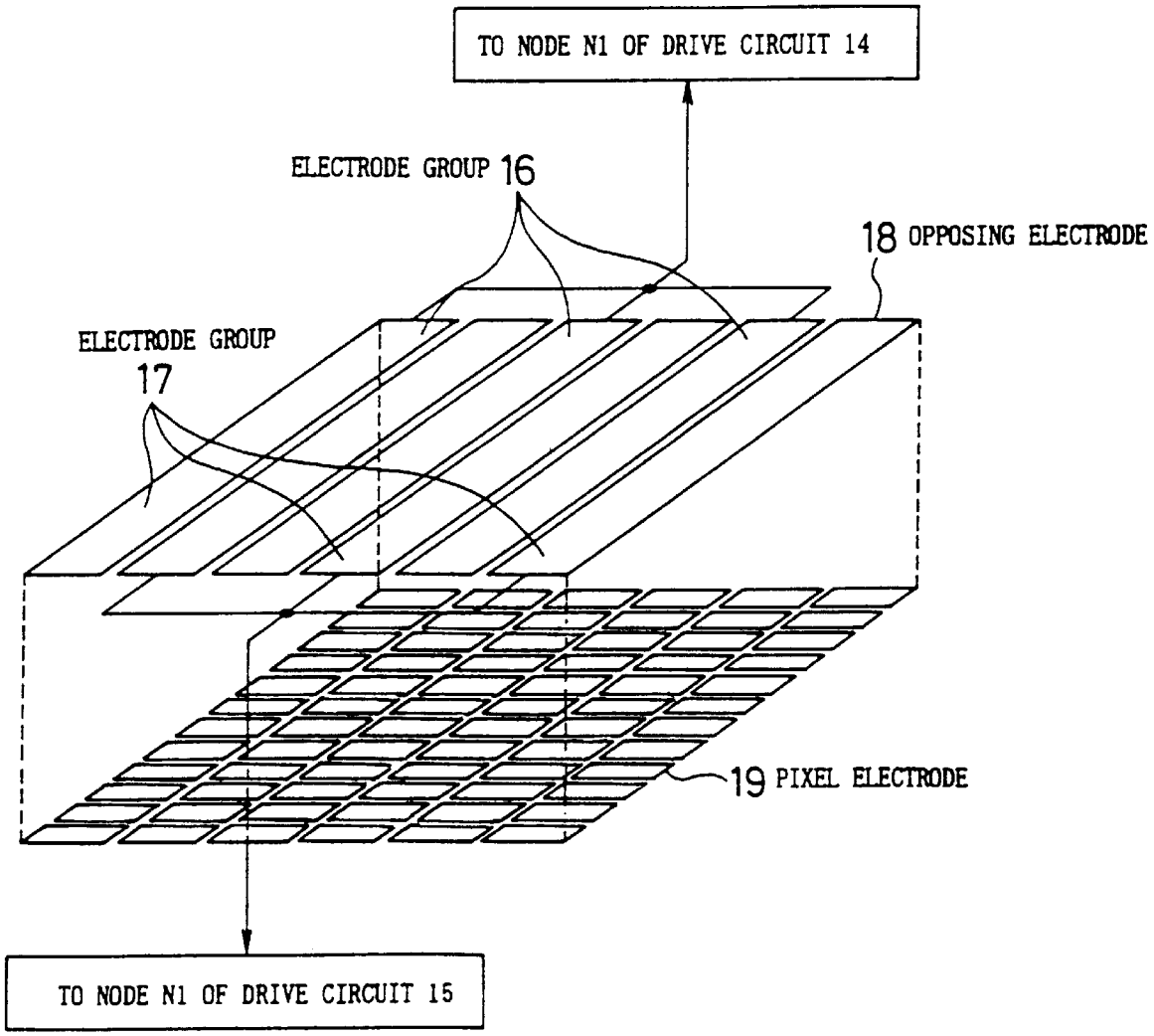
FIG. 6 is a drawing which shows the panel configuration for the purpose of illustrating the fifth embodiment of the present invention.

Turning to FIG. 5 and FIG. 6, we have another embodiment of the present invention. FIG. 5 shows the configuration of the present invention, while FIG. 6 shows the configuration of the panel of the present invention. In an active-matrix liquid crystal panel such as shown in FIG. 6, two electrode groups are formed. In that portions of the opposing electrodes 18 that are opposite the regions of pixel electrodes 19, which correspond to regions formed between every two pixel electrodes Lines adjacently and closely arranged to each other and which is in parallel to the data bus lines, are cut to be patterned so as to form a plurality of strip-like pieces of opposing electrodes and then every other thus-patterned strip-like pieces of opposing electrodes being joined, thus keeping them at the same potential, to form a first electrode group 16, and thus-patterned strip-like pieces of opposing electrodes other than the above-noted forming the first electrode group 16 being joined, thus keeping them at the same potential and forming a second electrode group 17, the first electrode group 16 being connected to the node N1 of the drive circuit 14, an the second electrode group 17 being connected to the node N1 of the drive circuit 15, so that a first driving circuit and a second driving circuit being formed, these first and second driving circuits being driven in mutually opposite phases.

Figure 7:
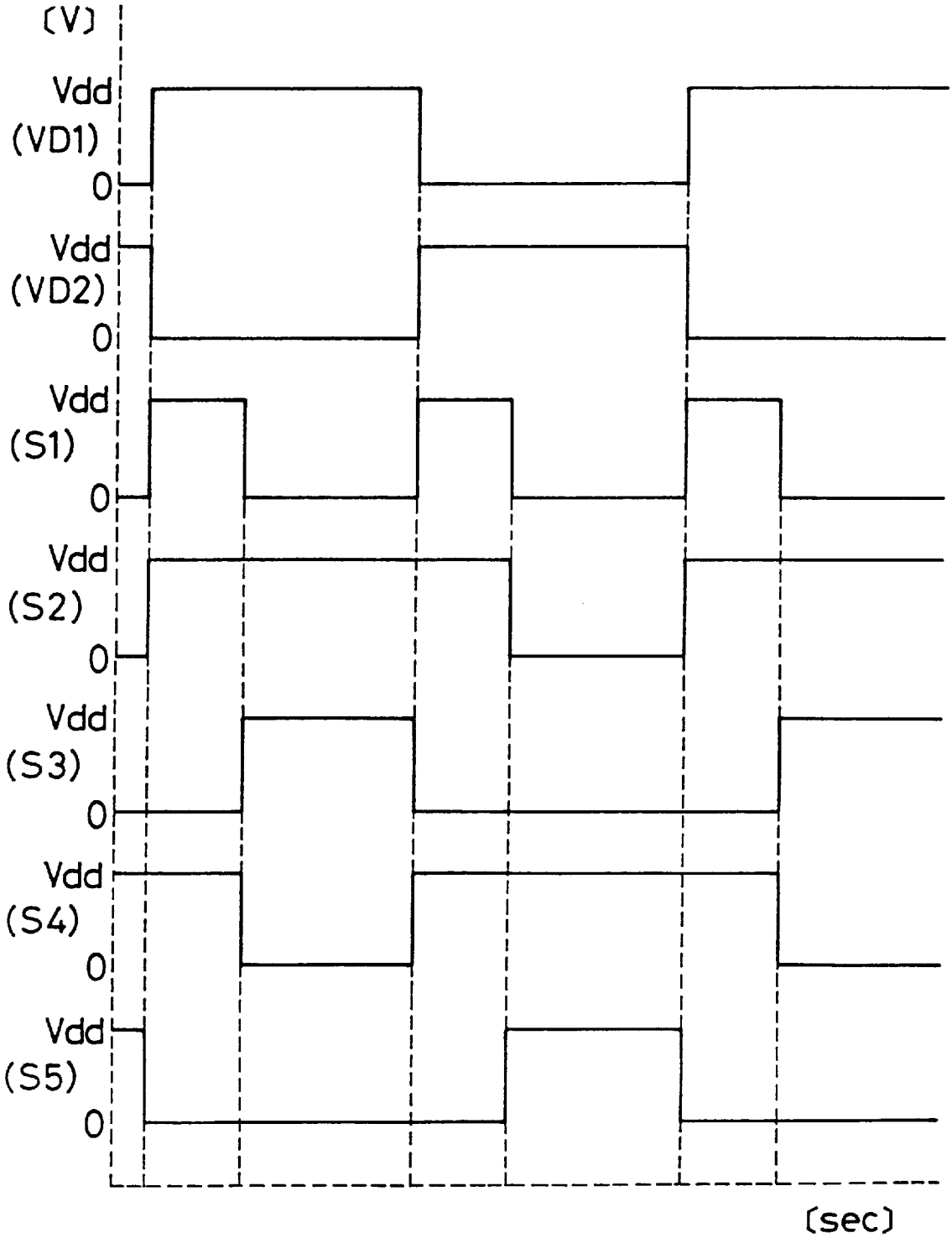
FIG. 7 is a drive signal waveform diagram which illustrates the fifth and seventh embodiments of the present invention.

The two data bus line drive circuits 8 and 13 are for the purpose of performing drive by the dot reversal driving method. FIG. 7 shows the drive signal waveforms.

As shown in FIG. 7, there are two data bus line signal waveforms VD1 and VD2 which are driven in mutually opposite phases, so that the phase is inverted every other line. Whereas with the panel construction as in the past, shown in FIG. 17, in which the opposing electrodes are formed by ITO over the entire area of the substrate, it was not possible to apply the dot reversal driving method, which features little deterioration of image quality, by using the configuration shown in FIG. 5 and FIG. 6, it is possible to use the dot reversal driving method.

In cutting the opposing electrodes 18 into long rectangular shapes, because it is possible to perform patterning of the opposing electrodes in the same manner as in the past, there is no increase in the complexity of process involved therein.

Figure 8:
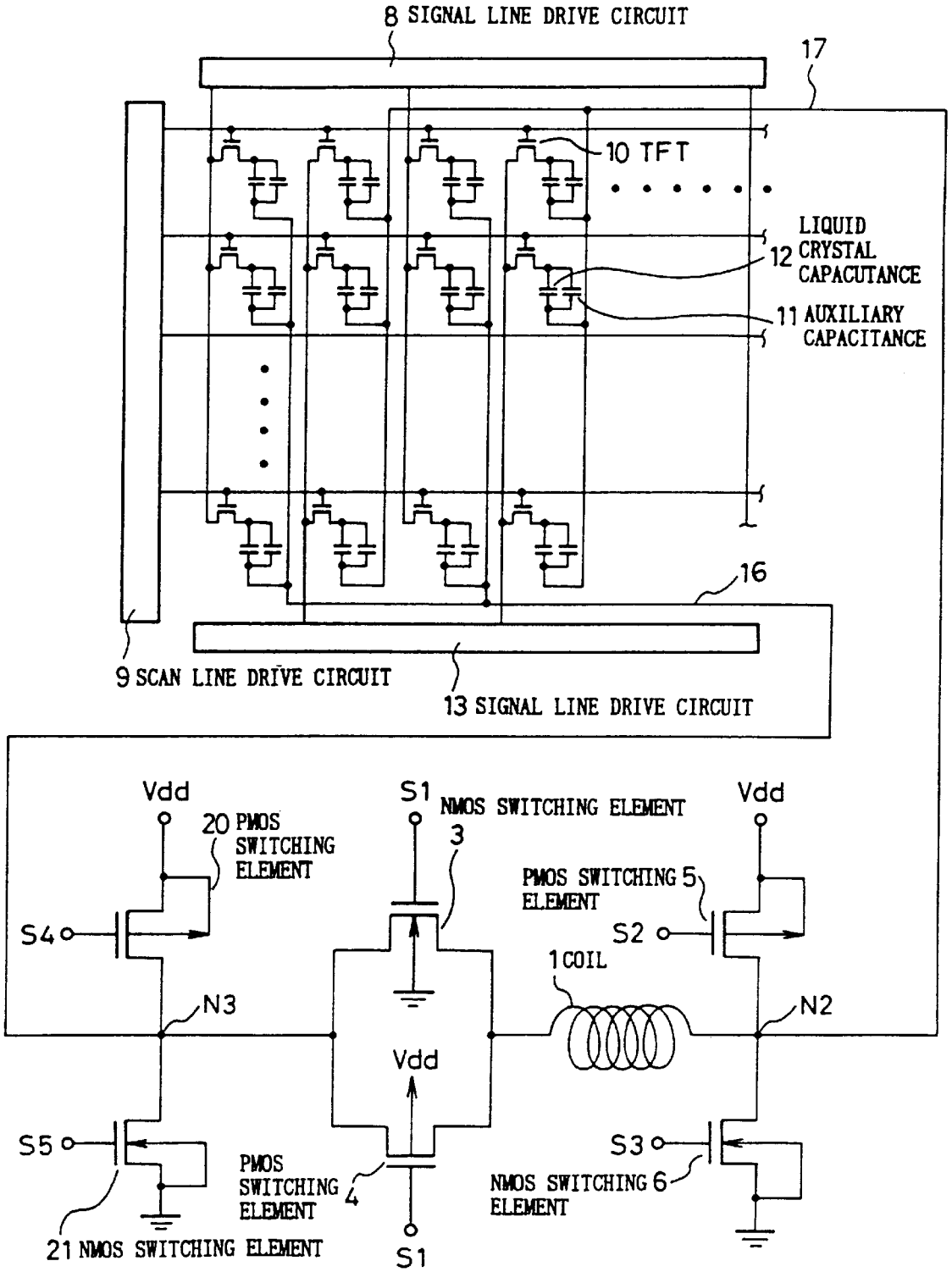
FIG. 8 is a drawing which shows the circuit configuration of the seventh embodiment of the present invention.

FIG. 8 shows another aspect of an embodiment of the present invention. This aspect of the present invention has yet a different low-power-consumption drive circuit configuration that enables use of the dot reversal driving method with respect to an active-matrix liquid crystal panel. The configuration of the panel is as shown in FIG. 6.

As shown in FIG. 6, two electrode groups, 16 and 17, are formed by joining every other line of the opposing electrodes 18, coil 1 being connected to the electrode group 16 via the CMOS transfer gate 30 formed by NMOS transistor 3 and PMOS transistor 4, and electrode group 17 being connected in series with coil 1 to form a series LC resonant circuit.

A PMOS transistor 5 is connected between the electrode group 17 and the positive drive voltage supply Vdd, an NMOS transistor 6 is connected between the electrode group 17 and the ground terminal, a PMOS transistor 20 is connected between the electrode group 16 and the positive drive voltage supply Vdd, and an NMOS transistor 21 is connected between the electrode group 16 and the ground terminal.

FIG. 7 shows the drive signal waveforms, from which it can be seen that, during the above-noted second time period, the terminal voltage V (N2) of the electrode group 17, is set to and held at 0 V, simultaneously with which the terminal voltage V (N3) of the electrode group 16 is set to and held at Vdd. In contrast to this, in the fourth time period, the terminal voltage V (N2) of the electrode group 17 is set to and held at Vdd, and the terminal voltage V (N3) of the electrode group 16 is set to and held at 0 V. The difference in the configuration of FIG. 8 in comparison with the configuration shown in FIG. 5 is that it is sufficient to have coil 1 and just one CMOS transfer gate, formed from the NMOS transistor 3 and the PMOS transistor 4, the capacitance 2 not being required, and also, because it is necessary to simultaneously drive the terminal voltage V (N3) of the electrode group 16 and the terminal voltage V (N2) of the electrode group 17, the PMOS transistor 20 and NMOS transistor 21 are added.

Next, individual embodiments of the present invention will be described in detail.

EMBODIMENT 1

The operation of the first embodiment, illustrated in FIG. 1, will be compared with that of a drive circuit of the past, which is shown in FIG. 18.

The drive circuit shown in FIG. 1 is formed by the coil 1, the NMOS transistors 3 and 6, the substrates of which are grounded, and the PMOS transistors 4 and 5, the substrate potentials of which are set to Vdd, this drive circuit driving the load capacitance 7.

The parallel-connected NMOS transistor 3 and PMOS transistor 4, to the gates of which are input the complementary signals S1 and S1/bar form an analog switching (CMOS transfer gate) circuit 30.

Referring to FIG. 1, in this embodiment of a drive circuit according to the present invention, the difference in comparison to the prior art drive circuit which is shown in FIG. 18 is that this embodiment does not have the diodes 47 and 48 which were present in the prior art drive circuit.

An additional feature of this embodiment of a drive circuit according to the present invention is the use of a CMOS transfer gate circuit 30 as an analog switching circuit, this CMOS transfer gate circuit 30 being formed by a grounded NMOS transistor which is connected in parallel with a PMOS transistor, the substrate potential of which is set to the drive voltage Vdd.

As described above, the drive circuit which is shown in FIG. 18 is known to be capable of low-power-consumption drive in the case in which the drive voltage Vdd is a high value, such as 100 V or greater. However, in the case of a low drive voltage such as approximately 5 V, it is not capable of low-power-consumption drive, making it difficult to perform low-power-consumption drive of such devices as liquid crystal displays using the prior art drive circuit which is shown in FIG. 18.

However, in this embodiment of drive circuit according to the present invention, as shown in FIG. 1, because there is no diode connected in series with the LC resonant circuit, it is possible to efficiently pass a low-voltage electrical charge between the load capacitance 7 and the coil 1, thereby enabling low-power-consumption drive even in the case of a low--drive-voltage liquid crystal display or the like.

Figure 12:
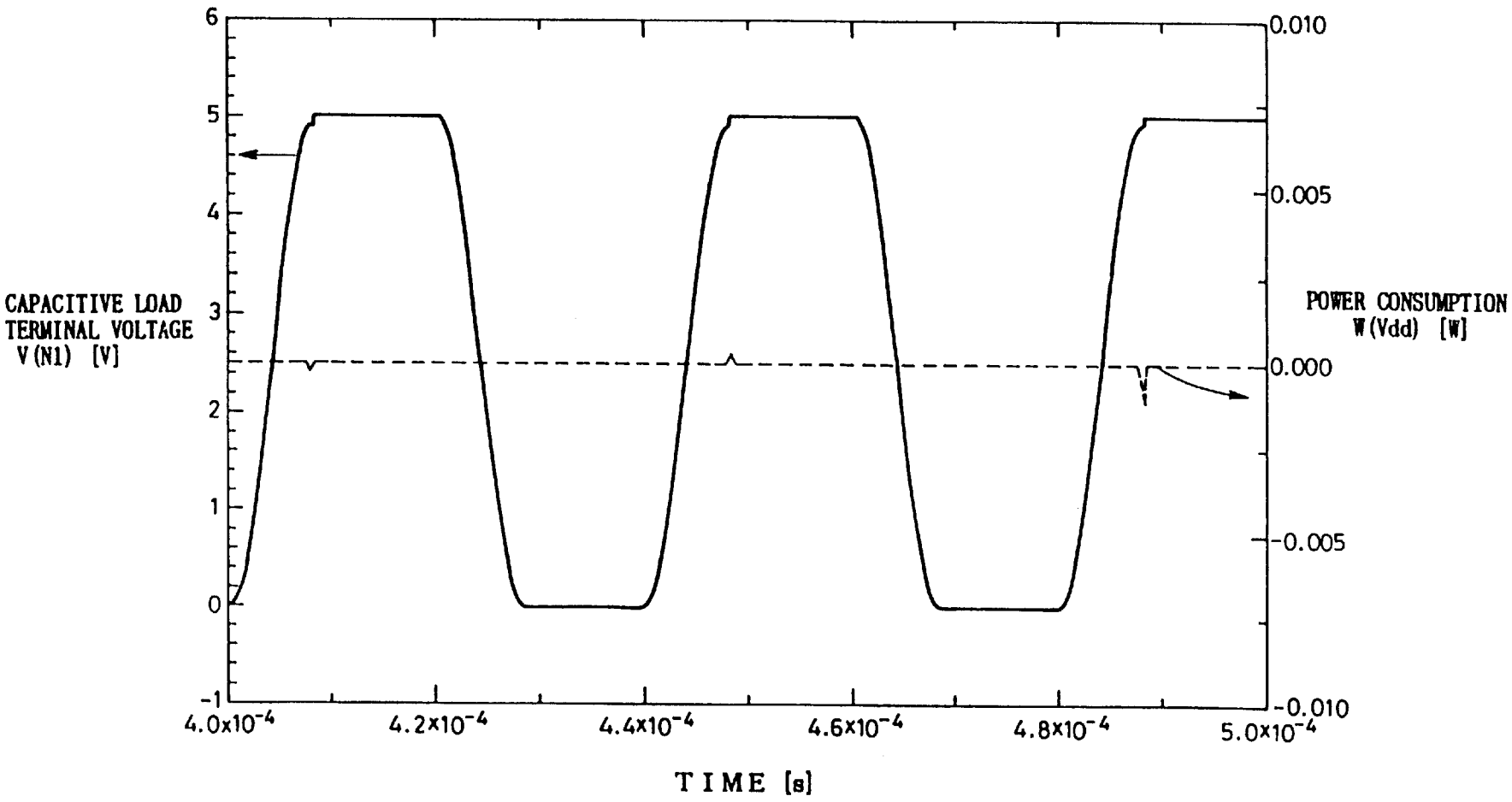
FIG. 12 is a drawing which shows the results of an actual measurement in the case of the first embodiment of the present invention.
Figure 13:
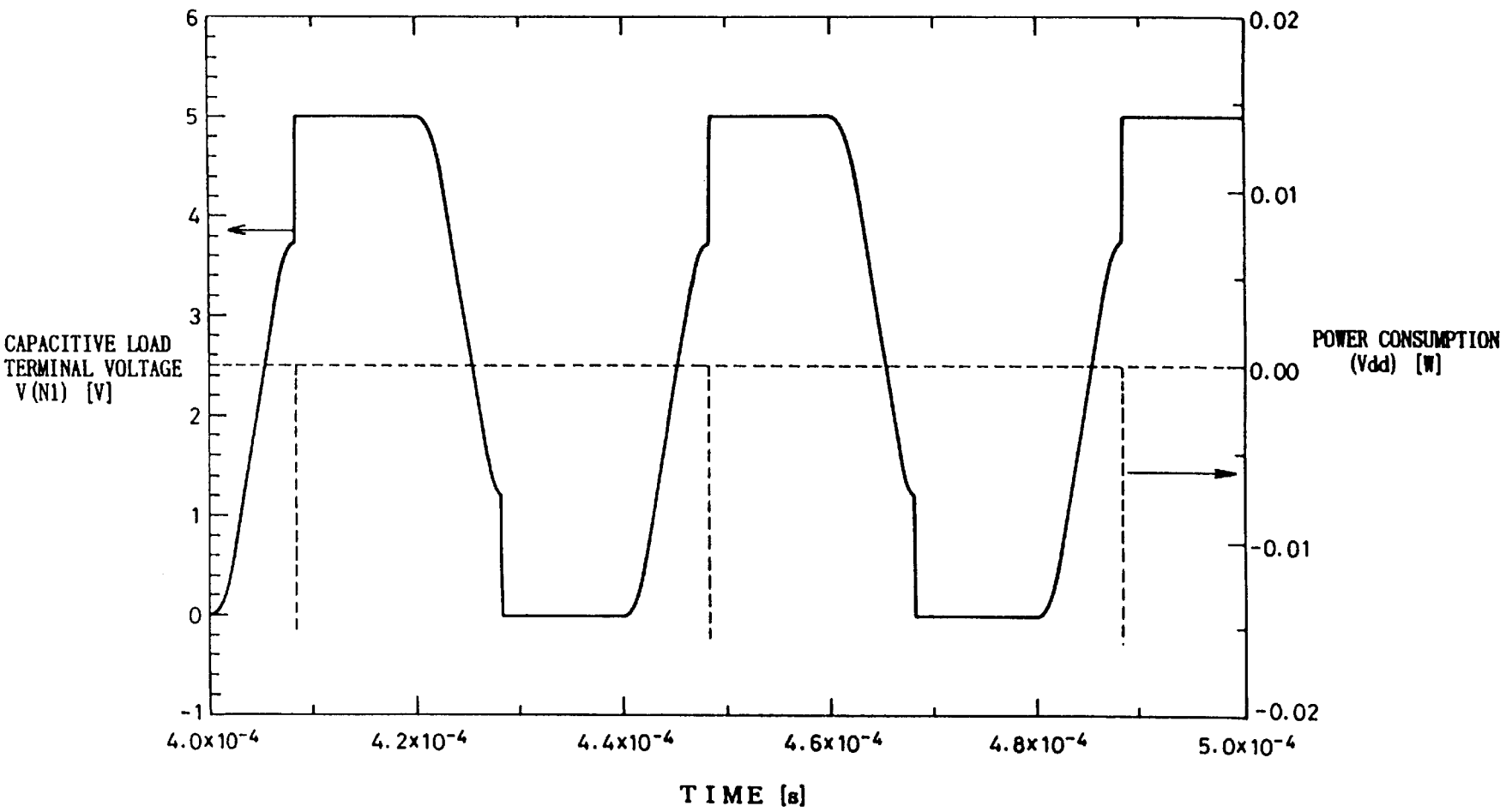
FIG. 13 is a drawing which shows the results of an actual measurement in the case of a prior art drive circuit.

FIG. 12 and FIG. 13 show an example of experimental results which clearly demonstrate the difference between this embodiment of a drive circuit according to the present invention and a prior art drive circuit, these drawings showing the time variations of the terminal voltage V (N1) of the load capacitance 7 and the power consumption from the Vdd power supply. FIG. 12 shows the ease of 5-V drive using this embodiment of the present invention as shown in FIG. 1, while FIG. 13 shows the case of 5-V drive using a prior art drive circuit as shown in FIG. 18.

In the case of the experimental results for this embodiment of the present invention shown in FIG. 12, the load capacitance 7 is 200 pF, the capacitance 2 is 20 nF, the inductance of coil 1 is 32.42 mH, and the resistance of coil 1 is 10 Ω. For the NMOS transistors 3 and 6, the electron mobility is 600 $cm^2/V\cdot s$, the channel length is 1 μm, the channel width is 100 μm, the gate oxide film thickness is 25 nm, and the threshold voltage is 1 V.

For the PMOS transistors 4 and 5, the hole mobility is 300 $cm^2/V\cdot s$, the channel length is 1 μm, the channel width is 200 μm, the gate oxide film thickness is 25 nm, and the threshold voltage is 1 V.

In the case of the experimental results shown in FIG. 13, for the prior art drive circuit drive circuit as shown in FIG. 18, the load capacitance 7 is 200 pF, the capacitance 2 is 20 nF, the inductance of coil 1 is 32.42 mH, and the resistance of coil 1 is 10 Ω, For the NMOS transistor, the electron mobility is 600 $cm^2/V\cdot s$, the channel length is 1 μm, the channel width is 100 μm, the gate oxide film thickness is 25 nm, and the threshold voltage is 1 V.

For the PMOS transistors, the hole mobility is 300 $cm^2/V\cdot s$, the channel length is 1 μm, the channel width is 200 μm, the gate oxide film thickness is 25 nm, and the threshold voltage is 1 V.

Diodes 47 and 48 had a forward voltage of 0.6 V. For the switching elements 43 and 44, a transfer gate was used, this being formed by the above-noted NMOS and PMOS transistors. For the switching element 45, the above-noted PMOS transistor was used, and for the switching element 46, the above-noted NMOS transistor was used.

The experimental results shown are for above-noted time period as explained with reference to the conventional driving circuit shown in FIG. 18, settings of approximately 8 μs for the first time period, approximately 12 μs for the second time period, approximately 8 μs for the third time period, and approximately 12 μs for the fourth time period.

FIG. 12 and FIG. 13 show the variations with time of load capacitance 7 terminal voltage V (N1) and the power consumption from the Vdd power supply, after the circuit had been in stable condition. From the experimental results shown in FIG. 13, it is possible to observe that, with the prior art drive circuit which is shown in FIG. 18, there is an approximately 1.2-V voltage discontinuity which is caused by the diode switching off when the voltage V (N1) rises and falls. Additionally, at the time that this discontinuity occurs when the voltage is rising, there is a sudden pulse-like increase in the power consumption peak value of approximately 15 mW.

In contrast to this, as shown in the experimental results of FIG. 12, with this embodiment of the drive circuit according to the present invention, there was virtually no voltage discontinuity when the voltage V (N1) rises and falls. Additionally, the power consumption was approximately 1 mW or less at all times. This demonstrates that operating effect of a drive circuit according to the present invention.

EMBODIMENT 2

FIG. 2 shows another embodiment of a drive circuit according to the present invention. In contrast to the embodiment of the drive circuit which is shown in FIG. 1, there is no capacitance 2, and the source potential of the NMOS transistor 6 is set to be the negative drive voltage (−Vdd).

While the operation of this circuit is similar to that of the drive circuit embodiment shown in FIG. 1, it differs from that drive circuit in that the terminal voltage of the load capacitance is periodically driven between +Vdd and −Vdd.

In the drive circuit shown in FIG. 2 as well, the load capacitance 7 is 200 pF, the inductance of coil 1 is 32.42 mH, and the resistance of coil 1 is 10 Ω. For the NMOS transistors 3 and 6, the electron mobility is 600 $cm^2/V\cdot s$, the channel length is 1 μm, the channel width is 100 μm, the gate oxide film thickness is 25 nm, and the threshold voltage is 1 V.

For the PMOS transistors 4 and 5, the hole mobility is 300 $cm^2/V\cdot s$, the channel length is 1 μm, the channel width is 200 μm, the gate oxide film thickness is 25 nm, and the threshold voltage is 1 V.

The experiment demonstrated that, using these circuit parameters it is possible to perform low-power-consumption drive.

EMBODIMENT 3

FIG. 3 shows another embodiment of a drive circuit according to the present invention. The drive circuit shown in FIG. 3 has an active-matrix liquid crystal panel as the load capacitance 7 shown in the drive circuit of FIG. 1, the opposing electrodes of this active-matrix liquid crystal panel being connected to and driven by node N1.

FIG. 4(*a*) shows the drive signal waveforms, of which Vg is the scanning line signal waveform and VD is the data bus line scanning waveform, drive being performed using the scan reversal driving method.

In driving the opposing electrodes, as shown in FIG. 4(*a*), the data bus line signal waveform VD is driven in synchronization with the rising of the signal waveform S1 which is applied to the gate electrodes of the NMOS switching element 3 and the PMOS switching element 4.

The data bus line signal waveform VD is driven in accordance with the image signal to be applied to the pixel electrodes, and the above-noted scanning lines and data bus lines are driven using the scan reversal driving method.

In performing AC drive of the opposing electrodes of an active-matrix liquid crystal panel, because it is necessary to complete the charging and discharging of the opposing electrodes within the writing time of the pixel electrode on the TFT substrate, coil 1 is provided, so that ½ of the period of resonance during which the NMOS switching element 3 and the PMOS switching element 4 are on is made shorter than the pixel electrode writing time.

Figure 14:
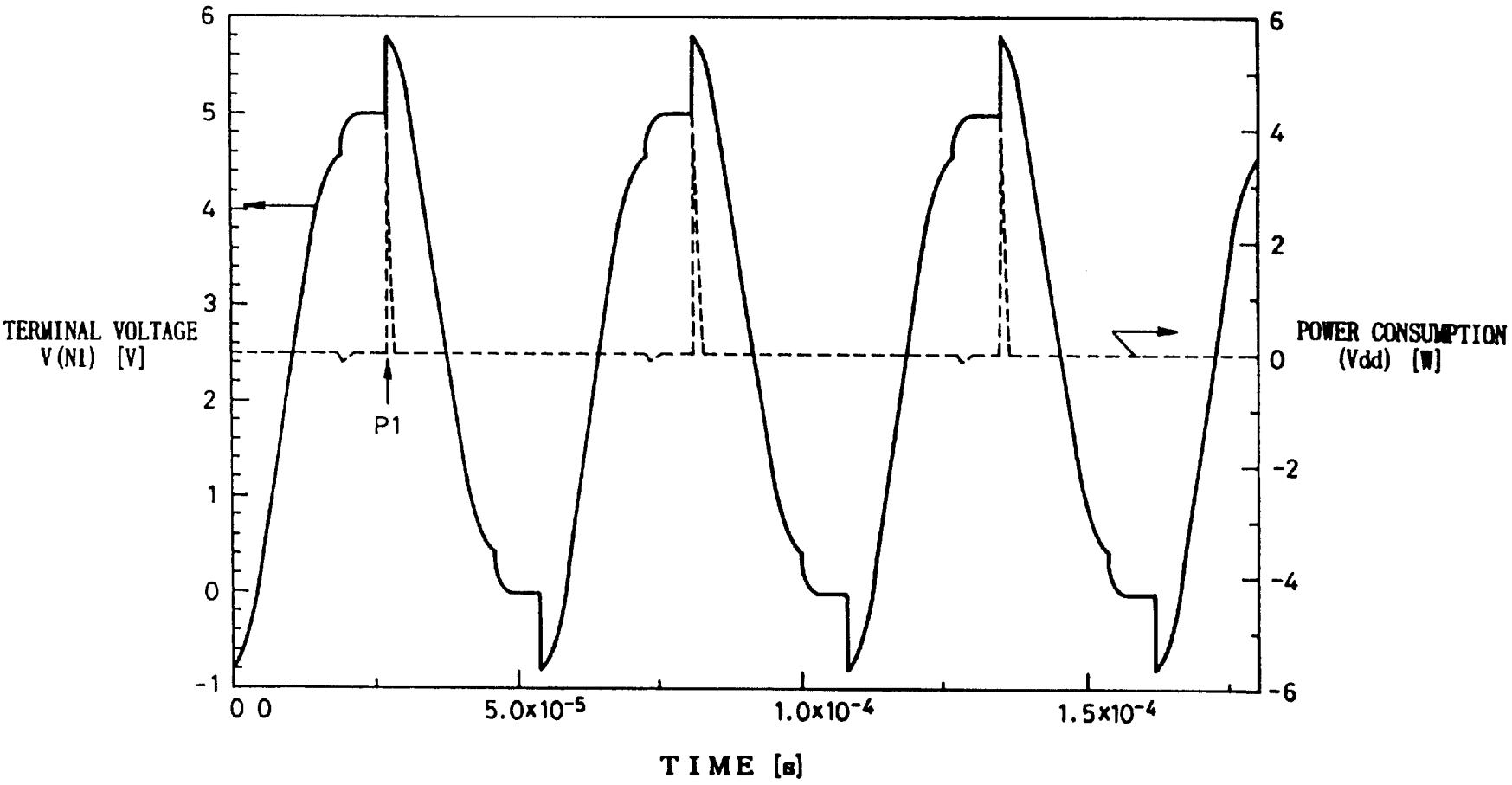
FIG. 14 is a drawing which shows the results of an actual measurement in the case of the third embodiment of the present invention.

FIG. 14 shows the results of an experiment in which a 6.5-inch panel was periodically driven between 0 V and 5 V, this drawing showing the time variations of the terminal voltage V (N1) of the load capacitance 7 and the power consumption from the Vdd power supply.

In the experiment shown in FIG. 14, the size of the panel was 6.5 inches the sheet resistance of the opposing electrodes is 5 Ω/square and the capacitance 2 is 100 μF. For the NMOS transistors 3 and 6, the electron mobility is 917 $cm^2/V\cdot s$, the channel length is 0.78 μm, the channel width is 800μm, the gate oxide film thickness is 16 nm, and the threshold voltage is 0.7 V.

For the PMOS transistors 4 and 5, the electron mobility is 643 $cm^2/V\cdot s$, the channel length is 0.94 μm, the channel width is 1600 μm, the gate oxide film thickness is 16 nm, and the threshold voltage is 0.8 V.

The glitch at the position P1 in FIG. 14 is caused by a change in the terminal voltage V (N1) due to the influence of the data bus line waveform which is applied to the data bus line. Although there is a large power consumption peak at the position P1, because this is discharging into the Vdd power supply, this does not represent an increase in the amount of power supplied from the Vdd power supply.

Thus, this is a demonstration of the operating effect of the drive circuit according to the present invention.

EMBODIMENT 4

In this embodiment of the present invention, the scanning signals which are applied to the scanning lines are scanned every other line, so that one frame is made up of a plurality of scanned frames, thus lengthening the pixel electrode writing time, and lengthening the reversal period of the signals applied to the source bus line and opposing electrodes.

In performing AC drive of the opposing electrodes as shown in FIG. 3, it is necessary to complete the charging and discharging of the opposing electrodes within the writing time of the pixel electrode.

Figure 17:
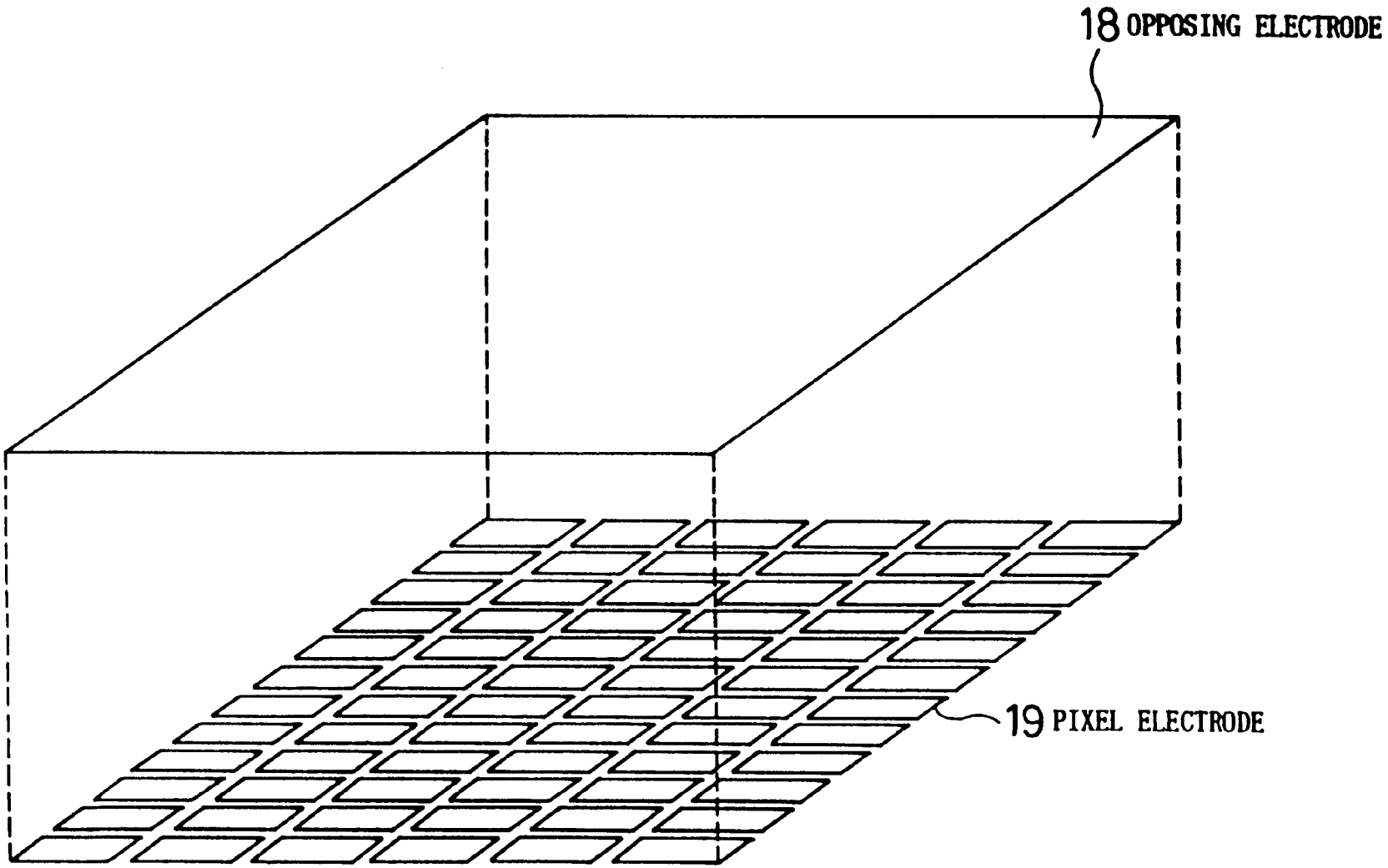
FIG. 17 is a drawing which shows the construction of a panel in the prior art.

With an active-matrix liquid crystal panel, the opposing electrodes are formed by covering the entire surface with ITO or the like, as shown in FIG. 17, and in the case, for example, in which an electrical charge is to be supplied from the four corners of an opposing electrode, when the potential of the opposing electrode 18 of the liquid crystal panel is set to the voltage Vdd, in supplying an electrical charge at the center part of the liquid crystal panel, the time is ½ of the period of resonance and the delay time because of an RC delay related to the parasitic resistance of the opposing electrode when supplying an electrical charge from the Vdd supply.

In the drive circuit which is shown in FIG. 1, the period T of the LC resonance during the time at which a series LC series resonant circuit is formed, and the terminal voltage V (N1) of the load capacitance 7 at an arbitrary time t are given by the following Equations (1) and (2).

$$T=4\pi L/(4L/C-R^2)^{1/2} \quad (1)$$

$$V(\mathbf{N1})[t]=\{\mathbf{C1}*\mathbf{V1}/(\mathbf{C1}+Cp))*[1-e^{-qt}\{\cos(\gamma t)+(q/\gamma)*\sin(\gamma t)\}] \quad (2)$$

In Equations (1) and (2), C1 and V1 are the capacitance value of capacitance 2 and the terminal voltage across the capacitance 2, Cp is the capacitance value of the load capacitance 7, and L is the inductance of the coil 1, and q, γ and C are as defined by the equations (3), (4) and (5) given below.

In Equations (1) and (2), R is the parasitic resistance component of the coil, the capacitance, and the switching elements.

$$q=-R/2L \quad (3)$$

$$\gamma>\{VLC-(R/2L)^2\}^{1/2} \quad (4)$$

$$C=Cp*\mathbf{C1}/(Cp+C1) \quad (5)$$

When the LC resonance is completed, that is, when the voltage V (N1) [t] is at its peak value, from Equations (1) and (2), V (N1) [T/2] is given as shown in Equation (6).

$$V(N1)\{T/2\}=\{C1*V1/(C1+Cp)\}*[1-exp\{-\pi/(4L/CR^2-1)^{1/2})] \quad (6)$$

With the circuit configuration which is shown FIG. 1, for the purpose of performing low-power-consumption drive, the inductance of the coil 1 can be made large, as is shown in Equation (6) above.

However, as can be also from Equation (1), to make the resonance time long, when performing AC drive of the opposing electrodes of a liquid crystal display, for a large-capacity panel it can be envisioned that it might be impossible to perform charging and discharging of opposing electrodes within the writing time, and for a high-precision panel, because the writing time becomes short, there is the possibility that charging and discharging will not be possible within this writing time.

Figure 15:
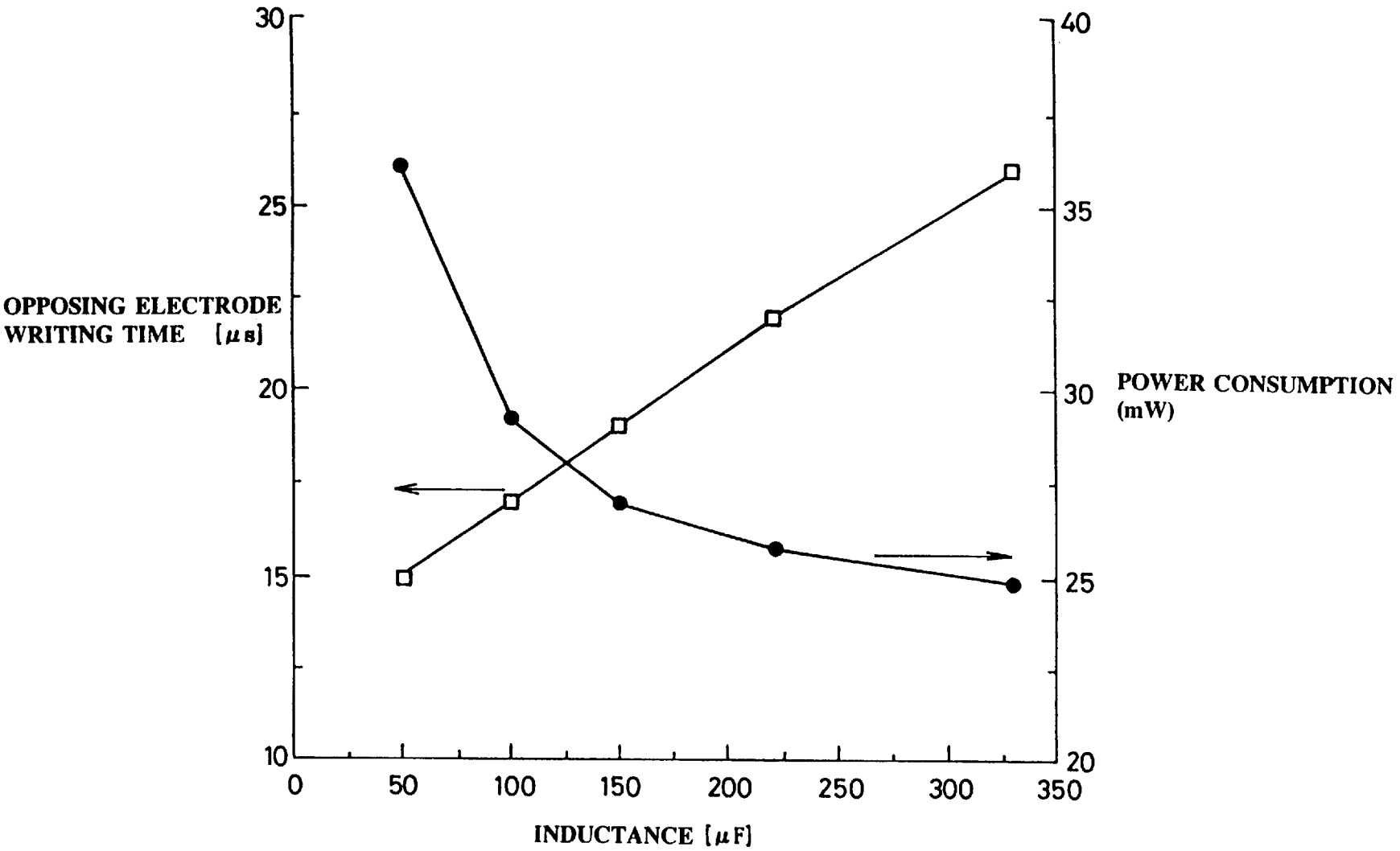
FIG. 15 is a drawing which shows, for the case of a 9.4-inch panel, the relationship of the inductance of coil 1, the opposing electrode write time (the time for the opposing electrode voltage to reach the voltage Vdd), and the power consumption.

FIG. 15 shows, for the case of a 9.4-inch panel, the relationship of the inductance of coil 1, the opposing electrode write time (the time for the opposing electrode voltage to reach the voltage Vdd), and the power consumption. In the experiment shown in FIG. 15, the size of the panel was 9.4 inches, the sheet resistance of the opposing electrodes is 20 Ω/square and the capacitance 2 is 100 μF.

For the NMOS transistors 3 and 6, the electron mobility is 917 $cm^2/V\cdot s$, the channel length is 0.78 μm, the channel width is 800 μm, the gate oxide film thickness is 16 nm, and the threshold voltage is 0.7 V. For the PMOS transistors 4 and 5, the electron mobility is 643 $cm^2/V\cdot s$, the channel length is 0.94 μm, the channel width is 1600 μm, the gate oxide film thickness is 16 nm, and the threshold voltage is 0.8 V.

In this embodiment of the present invention, the writing time is made long and so that the above-described first time period and third time period can be made long. The inductance of the coil 1 is made large, which makes the value of V (N1) [T/2] determined from Equation (6) large, thereby enabling a reduction in the amount of power supplied from the Vdd supply. Additionally, because the reversal period of the signals applied to the data bus lines and opposing electrodes is made long, a further reduction in power consumption is possible.

As embodiments of the present invention, FIG. 4(*a*) shows the case of using interlaced drive of the scanning signals applied to the scanning lines, while FIG. 4(*b*) shows the case of using the sequential scanning method of the past. By using interlaced drive, the frequency of the signal that is applied to the data bus lines and opposing electrodes is ½ that which would be applied in the case of line-sequential drive, and the pixel electrode writing time is more than doubled.

By doing this, compared with the case of line-sequential scanning the scanning line signals, it is possible to set the inductance of the coil 1 to be larger, thereby enabling a reduction in power consumption.

EMBODIMENT 5

FIG. 5 and FIG. 6 shows yet another embodiment of the present invention FIG. 5 shows the configuration of the drive circuit of the present invention, while FIG. 6 shows the related panel construction.

In an active-matrix liquid crystal panel such as shown in FIG. 6, two electrode groups are formed, the parts of the opposing eLectrodes 18 that are opposite the regions of pixel electrodes 19 in the data bus line direction being patterned in a direction that is parallel to data bus line direction, every other thus-patterned opposing electrode being joined, thus keeping them at the same potential, to form an electrode group 16, and the opposing electrodes 18 other than the above-noted electrode group 16 being joined, thus keeping them at the same potential and forming the electrode group 17, the electrode group 16 being connected to the node N1 of the drive circuit 14, an the electrode group 17 being connected to the node N1 of the drive circuit 15, a first driving circuit and a second driving circuit being formed, these first and second driving circuits being driven in mutually opposite phases.

The two data bus line drive circuits 8 and 13 are for the purpose of performing drive by the dot reversal driving method. FIG. 7 shows the drive signal waveforms.

As shown in FIG. 7, there are two data bus line signal waveforms VD1 and VD2 which are driven in mutually opposite phases, so that the phase is inverted every other line. Whereas with the panel construction as in the past, shown in FIG. 17, in which the opposing electrodes are formed by ITO over the entire screen area, it was not possible to apply the dot reversal driving method, which features little deterioration of image quality, by using the configuration shown in FIG. 5 and FIG. 6, it is possible to use the dot reversal driving method.

Figure 9:
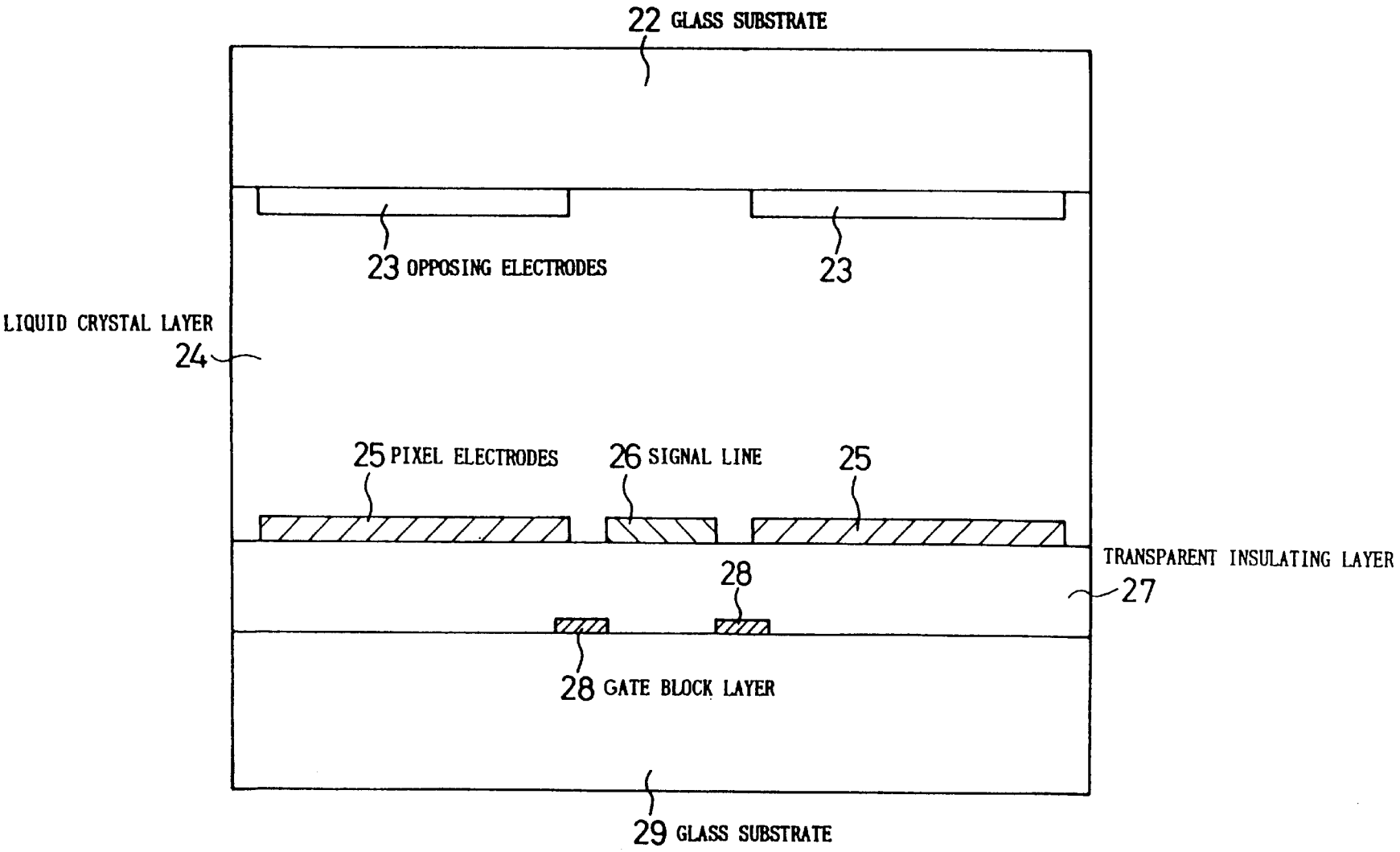
FIG. 9 is a cross-sectional view which shows an example of the construction of a panel in the case of the fifth embodiment of the present invention.

In cutting the opposing electrodes 18 into long rectangular shapes, because it is possible to perform patterning of the opposing electrodes in the same manner as in the past, there is no increase in the complexity of process involved therein. FIG. 9 shows a cross-sectional view of the pixel construction in the data bus line direction, as an embodiment of the panel construction of FIG. 6.

As shown in FIG. 9, the opposing electrodes 23 that are formed on the part of the glass substrate 29 that is opposite the region between the pixel electrodes 25 are patterned parallel to the direction of the data bus lines.

With the construction that is shown in FIG. 9, because the opposing electrodes 23 are formed only in the region that is opposite the region between the pixel electrodes 25 in the data bus line direction, it is possible to reduce the capacitance between the data bus lines and the opposing electrodes, and also possible to reduce the capacitance between the opposing electrodes 23 and each of the electrodes on the glass substrate 29.

With the construction shown in FIG. 9, the panel capacitance (capacitance between the opposing electrodes 23 and each of the electrodes on the glass substrate 29) of a 6.5-inch VGA panel is approximately 40 pF, this being approximately ½ of the panel capacity of approximately 80 pF with the panel construction of past that is shown in FIG. 3.

Additionally, because in this embodiment as shown in FIG. 5 the opposing electrodes are is divided into two and driven by two drive circuits, the load capacitance is half of that when performing drive with one drive circuit. By doing this, the resonance time, which is proportional to the value of Cp which is expressed by Equation (6) is shortened, the peak voltage V (N1) [T/2] that is inversely proportional to the value of Cp which is expressed by Equation (1) increasing, and the power consumption from the Vdd power supply decreasing. By adopting the construction shown in FIG. 5, it is possible to perform low-power-consumption drive using the dot reversal driving method which features little deterioration of image quality.

EMBODIMENT 6

Figures 10A, 10B:
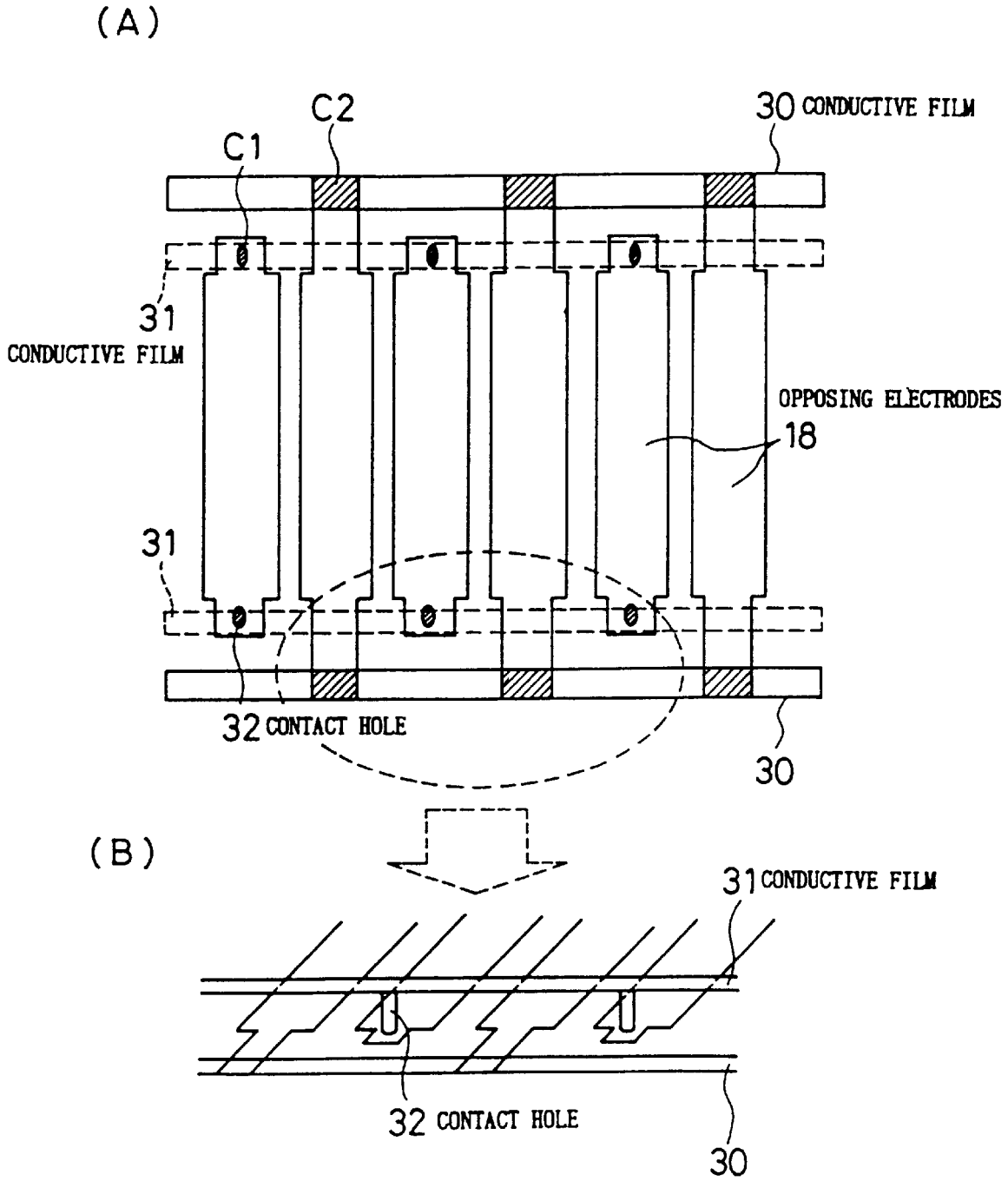
FIGS. 10(A) and 10(B) are drawings showing the opposing electrodes for illustrating the sixth embodiment of the present invention.

FIG. 10 shows another embodiment of the present invention. First, when forming the two electrode groups 16 and 17 as described for the fifth embodiment, as shown in FIG. 10, every other patterned opposing electrode 18 line is electrically connected at the C2 position by a conductor such as a conductive film 30 of Cr or A1, thus forming the electrode group 16 with a uniform potential.

Next, after depositing an insulation film onto the opposing electrodes 18, contact holes 32 are formed in the patterned opposing electrodes other than the ones joined to form the electrode group 16, by etching at positions such as C1, after which these are electrically connected via a conductor such as a conductive film 31 of Cr or A1, thus forming the electrode group 17 with a uniform potential.

By forming the electrode groups 16 and 17 having the construction as shown in FIG. 10, since it is possible to perform opposing electrode 18 writing from the top and bottom, it is possible to perform low-power-consumption drive with improved efficiency.

EMBODIMENT 7

FIG. 8 shows yet another embodiment of the present invention. In this embodiment, in an active-matrix liquid crystal panel, a low-power-consumption drive circuit having a different construction is used to enable dot reversal drive. The panel construction is as shown in FIG. 6, in which the opposing electrodes 18 are connected together at every other line to form two electrode groups 16 and 17.

The coil 1 is connected in series with the electrode group 16 via a CMOS transfer gate 30 that is formed by the NMOS transistor 3 and the PMOS transistor 4, and the electrode group 17 is connected in series with the coil 1, thereby forming a series LC resonant circuit. The PMOS transistor 5 is connected between the electrode group 16 an the positive drive voltage power supply Vdd, and the NMOS transistor 6 is connected between the electrode group 16 and the ground terminal.

The PMOS transistor 20 is connected between the electrode group 17 and the positive drive voltage power supply Vdd and the NMOS transistor 21 is connected between the electrode group 17 and the ground terminal. The drive signal waveforms are as shown in FIG. 7.

During the above-described second time period, the terminal voltage V (N2) of the electrode group 16 is set to and held at 0 V, simultaneously with which the terminal voltage V (N3) of the electrode group 17 is set to and held at Vdd. In contrast to this, during the above-described fourth time period, the terminal voltage V (N2) of the electrode group 16 is set to and held at Vdd, simultaneously with which the terminal voltage V (N3) of the electrode group 17 is set to and held at 0 V.

Figure 11:
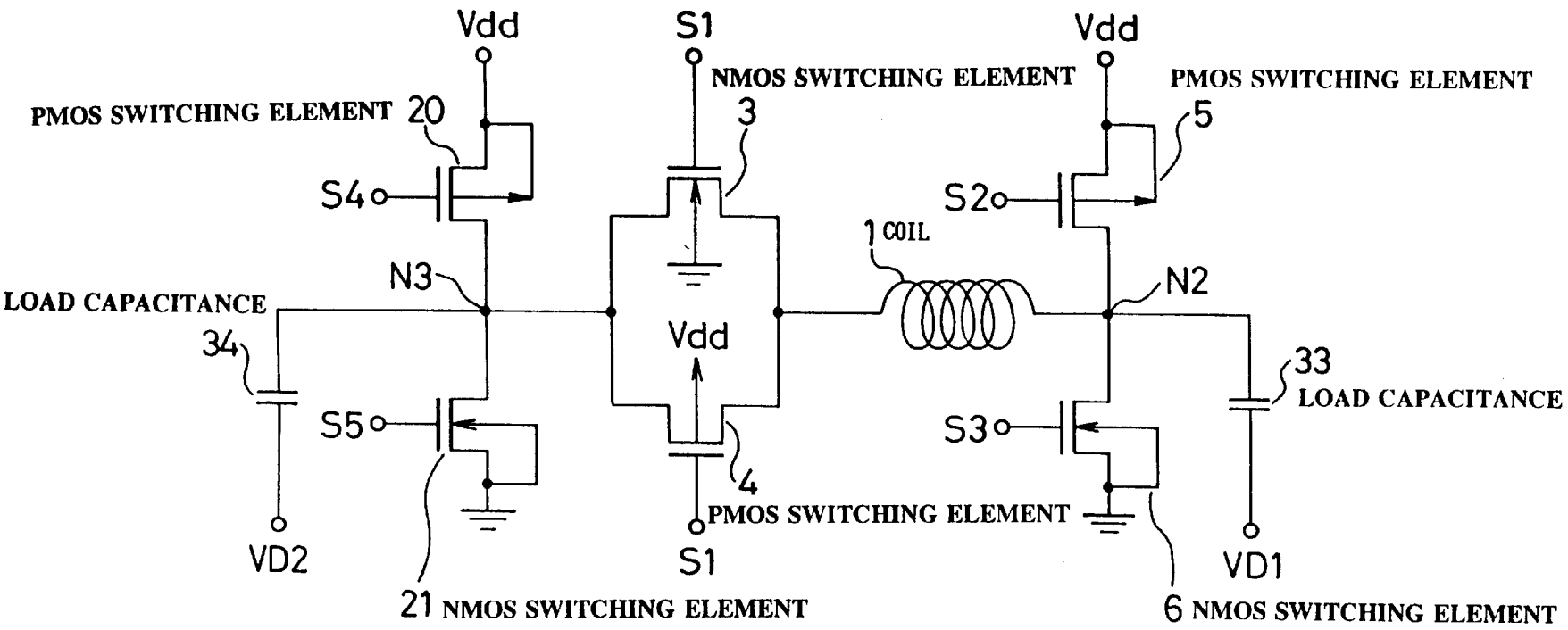
FIG. 11 is a circuit diagram which shows the basic construction of the seventh embodiment of the present invention.

The difference in the configuration of FIG. 8 in comparison with the configuration shown in FIG. 5 is that it is sufficient to have coil 1 and just one CMOS transfer gate, formed from the NMOS transistor 3 and the PMOS transistor 4, the capacitance 2 not being required, and also, because it is necessary to simultaneously drive the terminal voltage V (N3) of the electrode group 17 and the terminal voltage V (N2) of the electrode group 16, the PMOS transistor 20 and NMOS transistor 21 are added The basic circuit configuration of the configuration of FIG. 8 is shown in FIG. 11. The results obtained from a drive experiment the circuit shown in FIG. 11 are shown in FIG. 16.

In the case of the drive experiment shown in FIG. 15, the load capacitances 33 and 34 are 20 nF the inductance of the coil 1 is 1 mH, and the resistance of the coil 1 is 25 Ω. For the NMOS transistors 3, 6 and 21, the electron mobility is 917 $cm^2/V{\cdot}s$, the channel length is 0.78 $\mu$m, the channel width is 100 $\mu$m, the gate oxide film thickness is 16 nm, and the threshold voltage is 0.7 V. For the PMOS transistors 4, 5 and 20, the electron mobility is 643 $cm^2/V{\cdot}s$, the channel length is 1 $\mu$m, the channel width is 200 $\mu$m, the gate oxide film thickness is 16 nm, and the threshold voltage is 0.8 V.

Figure 16:
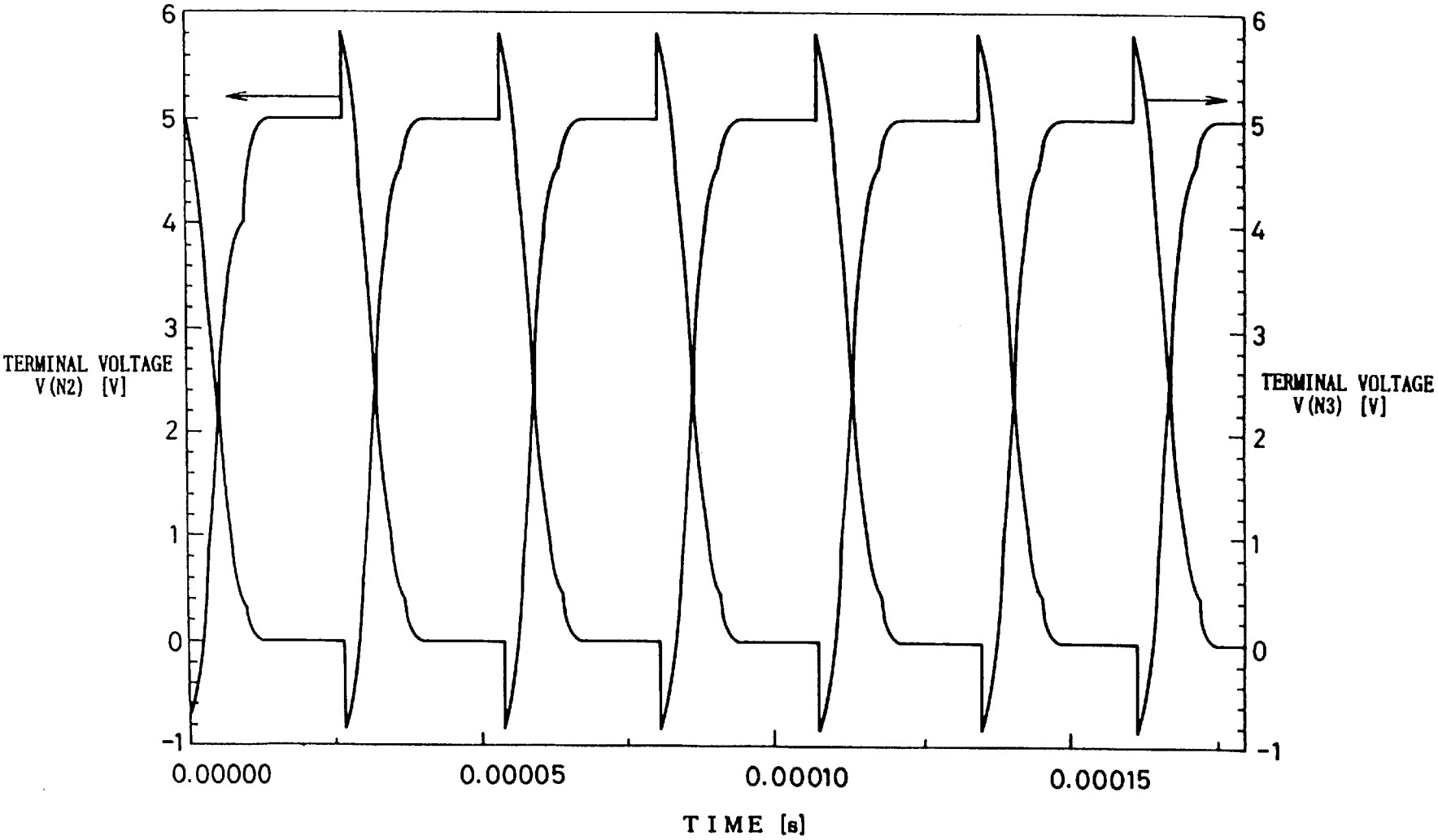
FIG. 16 is a drawing which shows the results of an actual measurement in the case of the seventh embodiment of the present invention.

From the results shown in FIG. 16, it was demonstrated that by using the configuration of FIG. 8, it is possible to perform low-power-consumption use the dot reversal driving method, which features little deterioration of image quality.

As described in detail above, according to the present inventions it is possible to perform low-power-consumption drive even for a low-voltage capacitive load. By using the driving methods and configurations of the fifth to seventh embodiments of the present invention, it is possible to perform low-power-consumption drive with high efficiency, by the dot reversal driving method, which features little deterioration of image quality.

As apparent from the above-mentioned explanations about the present invention, several aspects of the method for driving the load capacitance driving circuit of the present invention can be presented as follows;

One aspect of which is a driving method for driving a load capacitance drive circuit, wherein a load capacitance drive circuit comprising, a capacitance, an analog switching circuit, and an inductive element, a first end of said capacitance being grounded and a second end of which being connected in series via said analog switching circuit to a first end of said inductive element, while a load capacitance, a first end of which being connected to a first power source, is connected to a second end of said inductive element via a second end of of said load capacitance, or comprising an inductive element, and an analog switching circuit, a first end of said inductive element being grounded and a second end of which being connected in series via said analog switching circuit to a second end of a load capacitance, a first end of which being connected to a first power source, thereby forming a series LC resonant circuit; and wherein an NMOS switching element and a PMOS switching element being provided between said second end of said load capacitance and said first power source and between said second end of said load capacitance and a second power source, which being different from said first power source, respectively, and further said load capacitance is an active-matrix liquid crystal display panel in which each one of said pixel electrodes provided on a first substrate is arranged on a portion in the vicinity of each intersection of scan lines and data bus lines both also being formed on a surface of said first substrate, while each of said scan lines being connected to a gate electrode of each one of a switching element, each of said data bus lines being connected to a source electrode of each one of said switching elements and each one of said pixel electrodes being connected to a drain electrode of each one of said switching elements, wherein said method is characterized in that a signal waveform applied to an said data bus line on said first substrate is driven so as to correspond to a pixel signal to be applied to said pixel electrode, and in synchronization with the rising edge and falling edge of this signal waveform, the following four time periods are sequentially repeated, said time periods comprising a first time period in which, with both an NMOS switching element and a PMOS switching element in OFF condition, said analog switching circuit is turned ON for a period of time that is approximately ½ the period of a resonant frequency of the LC series resonant circuit formed by said inductive element, capacitance, and active-matrix liquid crystal panel, thereby transferring an electrical charge that was stored in said opposing electrodes of said active-matrix liquid crystal panel to said inductive element, a second time period in which, with both said analog switching circuit and said PMOS switching element in OFF condition, said NMOS switching element is turned ON, a third time period during which, with both said NMOS switching element and said PMOS switching element in OFF condition said analog switching circuit is turned ON for a period of time that is approximately ½ the period of said resonant frequency, thereby transferring an electrical charge that was stored in said inductive element to said opposing electrodes of said active-matrix liquid crystal panel, and a fourth time period during which, with both said analog switching circuit and said NMOS switching element in OFF condition, said PMOS switching element is turned ON, the sequential repeating of said time periods performing AC voltage drive of said opposing electrodes, this performing sequential driving (scan line inversion driving) of said scan lines and said data bus lines so that the polarity of the voltage applied to said pixel electrode with respect to said electrode is reversed for each neighboring scan line.

The second aspect of a driving method for driving a load capacitance drive circuit of the present invention is the one in the above-mentioned method the scanning operation is performed of the scanning line signal applied to said scanning lines, skipping one or more lines on each scan, so that a plurality of frames forms one screen.

Further the third aspect of a driving method for driving a load capacitance drive circuit of the present invention is a driving method for driving a load capacitance drive circuit, said load capacitance drive circuit comprising, a capacitance, an analog switching circuit, and an inductive element, a first end of said capacitance being grounded and a second end of which being connected in series via said analog switching circuit to a first end of said inductive element, while a load capacitance, a first end of which being connected to a first power source, is connected to a second end of said inductive element via a second end of said load capacitance, thereby forming a series LC resonant circuit; and wherein an NMOS switching element and a PMOS switching element being provided between said second end of said load capacitance and said first power source and between said second end of said load capacitance and a second power source, which being different from said first power source, respectively, and wherein said load capacitance is said active-matrix liquid crystal display panel, and further wherein, in said active-matrix liquid crystal display panel, said opposing electrode being divided into a plurality of strip-like opposing electrodes by patterning said opposing electrode in parallel with said data bus lines and said plurality of strip-like opposing electrodes being divided into at least two groups, a first electrode group being formed by joining every other line of said patterned opposing electrodes and set to the same potential, while a second electrode group being formed by joining every other line of the patterned opposing electrodes other than those of said first electrode group to set them to the same potential, and said circuit further is characterized in that said patterned opposing electrodes of said first electrode group are connected to a second end terminal of said inductive element of one of said load capacitance drive circuit, forming a first driving circuit, while said patterned opposing electrodes of said second electrode group are connected to said second end terminal of said inductive element of another Load capacitance drive circuit, forming a second driving circuit, wherein said method is characterized in that said first driving circuit and said second driving circuit being driven in opposite phase by a driving circuit operation method in that a signal waveform applied to an said data bus line on said first substrate is driven so as to correspond to a pixel signal to be applied to said pixel electrode, and in synchronization with the rising edge and falling edge of this signal waveform, the following four time periods are sequentially repeated, said time periods comprising a first time period in which, with both an NMOS switching element and a PMOS switching element in OFF condition, said analog switching circuit is turned ON for a period of time that is approximately ½ the period of a resonant frequency of the LC series resonant circuit formed by said inductive element, capacitance, and active-matrix liquid crystal panel, thereby transferring an electrical charge that was stored in said opposing electrodes of said active-matrix liquid crystal panel to said inductive element, a second time period in which, with both said analog switching circuit and said PMOS switching element in OFF condition, said NMOS switching element is turned ON, a third time period during which, with both said NMOS switching element and said PMOS switching element in OFF condition said analog switching circuit is turned ON for a period of time that is approximately ½ the period of said resonant frequency, thereby transferring an electrical charge that was stored in said inductive element to said opposing electrodes of said active-matrix liquid crystal panel, and a fourth time period during which, with both said analog switching circuit and said NMOS switching element in OFF condition, said PMOS switching element is turned ON, the sequential repeating of said time periods performing AC voltage drive of said opposing electrodes, this performing sequential driving (scan line inversion driving) of said scan lines and said data bus lines so that the polarity of the voltage applied to said pixel electrode with respect to said electrode is reversed for each neighboring scan line, said method is further characterized in that said first driving circuit and said second driving circuit of the drive circuit are driven by dot reversal driving, in that said first driving circuit and said second driving circuit being driven in opposite phases by the driving method, wherein in said first and said second driving circuit groups, in synchronization with a rise of the signal waveform applied to said analog switching circuit, said signal waveform applied to said data bus line on said first substrate is driven in correspondence to a pixel signal to be applied to said pixel electrode, this performing sequential driving of said scan lines and said data bus lines of said first substrate so that the polarity of a voltage applied to said pixel electrode with respect to said electrode is reversed for each neighboring pixel electrode. The fourth aspect of the method for driving such load capacitance driving circuit of the present inventions is a driving method for driving a load capacitance drive circuit, said load capacitance drive circuit comprising, a capacitance, an analog switching circuit, and an inductive element, a first end of said capacitance being grounded and a second end of which being connected in series via said analog switching circuit to a first end of said inductive element, while a load capacitance, a first end of which being connected to a first power source, is connected to a second end of said inductive element via a second end of said load capacitance, thereby forming a series LC resonant circuit; and wherein said capacitance and said load capacitance are both a part of said active-matrix liquid crystal display panel, in that said opposing electrode being divided into a plurality of strip-like opposing electrodes by patterning said opposing electrode in parallel with said data bus lines and said plurality of strip-like opposing electrodes being divided into at least two groups, a first electrode group being formed by joining every other line of said patterned opposing electrodes and set to the same potential, while a second electrode group being formed by joining every other line of the patterned opposing electrodes other than those of said first electrode group to set them to the same potential, and said driving circuit is further characterized in that said patterned opposing electrodes of said first electrode group are connected to said second end terminal of said inductive element of said load capacitance drive circuit forming a first driving circuit, while said patterned opposing electrodes of said second electrode group are connected to said first end terminal of said inductive element of said load capacitance drive circuit via said analogy switching circuit and forming a second driving circuit, wherein a PMOS switching element being connected between said second end terminal of said inductive element and a positive drive voltage supply, an NMOS switching element being connected between said second end terminal of said inductive element and a ground terminal, a PMOS switching element being connected between one end of said analog switching circuit connected to said first end terminal of said inductive element and a positive drive voltage supply, and an NMOS switching element being connected between one end of said analog switching circuit connected to said first end terminal of said inductive element and a ground terminal, wherein said method is characterized in that said scan lines and said data bus lines are driven by said dot reversal driving method, a first electrode group potential and a second electrode group potential being driven with opposite polarities, said driving operation being performed so that said PMOS switching element which is connected between said first electrode group and said positive drive voltage supply and the NMOS switching element which is connected between said second electrode group and said ground terminal are ON simultaneously, and further said NMOS switching element which is connected between said first electrode group and the ground terminal and said PMOS switching element which is connected between said second electrode group and the positive drive voltage supply are ON simultaneously.

What is claimed is:

1. A load capacitance drive circuit comprising:

a capacitance, an analog switching circuit, and an inductive element, a first end of said capacitance being grounded and a second end of which being connected in series via said analog switching circuit to a first end of said inductive element, while a load capacitance, a first end of which being connected to a first power source, is connected to a second end of said inductive element via a second end of said load capacitance, thereby forming a series LC resonant circuit; and wherein a first and a second MOS switching elements being provided between said second end of said load capacitance and said first power source and between said second end of said load capacitance and a second power source, which being different from said first power source, respectively.

2. A load capacitance drive circuit according to claim 1, wherein said second power source is a positive driving power source, while said first power source is either one of a power source having a grounding voltage level or a negative driving power source.

3. A load capacitance drive circuit according to claim 2, wherein said first MOS switching element is a NMOS switching element, while said second MOS switching element is a PMOS switching element.

4. A load capacitance drive circuit according to claim 1, wherein said analog switching circuit comprises a transfer gate circuit.

5. A load capacitance drive circuit according to claim 3, wherein said PMOS switching element, said NMOS switching element, and said analog switching circuit are formed by thin-film transistor elements.

6. A load capacitance drive circuit comprising:

a capacitance, an analog switching circuit, and an inductive element, one end of said capacitance being grounded and other end of which is connected in series via said analog switching circuit to one end of said inductive element, while the other end of said inductive element being connected to one end of a load capacitance, the other end of said load capacitance being grounded, thereby forming a series LC resonant circuit;

a PMOS switching element which is connected between the ungrounded end of said load capacitance and a positive drive voltage supply; and an NMOS switching element which is connected between the ungrounded end of said load capacitance and a ground terminal.

7. A load capacitance drive circuit comprising:

an inductive element, and an analog switching circuit, a first end of said inductive element being grounded and a second end of which being connected in series via said analog switching circuit to a second end of a load capacitance, a first end of which being connected to a first power source, thereby forming a series LC resonant circuit; and wherein a first and a second MOS switching elements being provided between said second end of said load capacitance and said first power source and between said second end of said load capacitance and a second power source, which being different from said first power source, respectively.

8. A load capacitance drive circuit according to claim 7, wherein said second power source is a positive driving power source, while said first power source is either one of a power source having a grounding voltage level or a negative driving power source, or both.

9. A load capacitance drive circuit according to claim 7, wherein said analog switching circuit comprises a transfer gate circuit.

10. A load capacitance drive circuit according to claim 7, wherein said PMOS switching element, said NMOS switching element, and said analog switching circuit are formed by thin-film transistor elements.

11. A load capacitance drive circuit comprising:

an inductive element and an analog switching circuit, one end of said inductive element being grounded and other end of which is connected in series via said analog switching circuit to one end of a load capacitance, the other end of said load capacitance being grounded, thereby forming a series LC resonant circuit;

a PMOS switching element which is connected between the ungrounded end of said load capacitance and a positive drive voltage supply; and an NMOS switching element which is connected between the ungrounded end of said load capacitance and a negative drive voltage supply.

12. A load capacitance drive circuit according to claim 1, wherein said load capacitance is a liquid crystal display panel which comprises a first substrate provided with a plurality of pixel electrodes on a surface thereof and a second substrate provided with opposing electrodes on a surface thereof, both of said first and second substrates being parallely and closely arranged to each other with containing liquid crystal in a space formed therebetween, so that said liquid crystal of said panel can be driven by applying electric voltage across to said pixel electrodes and said opposing electrodes.

13. A load capacitance drive circuit according to claim 12, wherein said liquid crystal display panel is an active-matrix liquid crystal display panel in which each one of said pixel electrodes provided on said first substrate is arranged on a portion in the vicinity of each intersection of scan lines and data bus lines both also being formed on a surface of said first substrate, while each of said scan lines being connected to a gate electrode of each one of switching elements formed by thin-film field-effect transistors (TFTs), each of said data bus lines being connected to a source electrode of each one of said TFTs and each one of said pixel electrodes being connected to a drain electrode of each one of said TFTs.

14. A load capacitance drive circuit according to claim 7, wherein said load capacitance is a liquid crystal display panel which comprises a first substrate provided with a plurality of pixel electrodes on a surface thereof and a second substrate provided with opposing electrodes on a surface thereof, both of said first and second substrates being parallely and closely arranged to each other with containing liquid crystal in a space formed therebetween, so that said liquid crystal of said panel can be driven by applying electric voltage across to said pixel electrodes and said opposing electrodes.

15. A load capacitance drive circuit according to claim 14, wherein said liquid crystal display panel is an active-matrix liquid crystal display panel in which each one of said pixel electrodes provided on said first substrate is arranged on a portion in the vicinity of each intersection of scan lines and data bus lines both also being formed on a surface of said first substrate, while each of said scan lines being connected to a gate electrode of each one of a switching elements formed by thin-film field-effect transistors (TFTs), each of said data bus lines being connected to a source electrode of each one of said TFTs and each one of said pixel electrodes being connected to a drain electrode of each one of said TFTs.

16. A load capacitance drive circuit according to claim 1, wherein said capacitance is either one of a liquid crystal display panel or an active-matrix liquid crystal display panel.

17. A load capacitance drive circuit according to claim 1, wherein said capacitance and said load capacitance are both either one of a liquid crystal display panel or an active-matrix liquid crystal display panel.

18. A load capacitance drive circuit according to claim 13, wherein said opposing electrodes of said liquid crystal display panel are connected to either one of a first and a second end terminals of said inductive element directly or via an analog switching circuit.

19. A load capacitance drive circuit according to claim 7, wherein said load capacitance is either one of a liquid crystal display panel or an active-matrix liquid crystal display panel.

20. A load capacitance drive circuit according to claim 15, wherein said opposing electrodes of said liquid crystal display panel are connected to a second end terminals of said inductive element via an analog switching circuit.

21. A load capacitance drive circuit according to claim 13, wherein said load capacitance is said active-matrix liquid crystal display panel, and further wherein, in said active-matrix liquid crystal display panel, said opposing electrode being divided into a plurality of strip-like opposing electrodes by patterning said opposing electrode in parallel with said data bus lines and said plurality of strip-like opposing electrodes being divided into at least two groups, a first electrode group being formed by joining every other line of said patterned opposing electrodes and set to the same potential, while a second electrode group being formed by joining every other line of the patterned opposing electrodes other than those of said first electrode group to set them to the same potential, and said circuit further is characterized in that said patterned opposing electrodes of said first electrode group are connected to said second end terminal of said inductive element of said load capacitance drive circuit, forming a first driving circuit, while said patterned opposing electrodes of said second electrode group are connected to said second end terminal of said inductive element of said load capacitance drive circuit, forming a second driving circuit.

22. A load capacitance drive circuit according to claim 13, wherein said capacitance and said load capacitance are both a part of said active-matrix liquid crystal display panel, and further wherein, in said active-matrix liquid crystal display panel, said opposing electrode being divided into a plurality of strip-like opposing electrodes by patterning said opposing electrode in parallel with said data bus lines and said plurality of strip-like opposing electrodes being divided into at least two groups, a first electrode group being formed by joining every other line of said patterned opposing electrodes and set to the same potential, while a second electrode group being formed by joining every other line of the patterned opposing electrodes other than those of said first electrode group to set them to the same potential, and said circuit further is characterized in that said patterned opposing electrodes of said first electrode group are connected to said second end terminal of said inductive element of said load capacitance drive circuit forming a first driving circuit, while said patterned opposing electrodes of said second electrode group are connected to said first end terminal of said inductive element of said load capacitance drive circuit via said analogy switching circuit and forming a second driving circuit.

23. A load capacitance drive circuit according to claim 22, wherein a PMOS switching element being connected between said second end terminal of said inductive element and a positive drive voltage supply, an NMOS switching element being connected between said second end terminal of said inductive element and a ground terminal, a PMOS switching element being connected between one end of said analog switching circuit connected to said first end terminal of said inductive element and a positive drive voltage supply, and an NMOS switching element being connected between one end of said analog switching circuit connected to said first end terminal of said inductive element and a ground terminal.

24. A driving method for driving a load capacitance drive circuit, wherein a load capacitance drive circuit comprising, a capacitance, an analog switching circuit, and an inductive element, a first end of said capacitance being grounded and a second end of which being connected in series via said analog switching circuit to a first end of said inductive element, while a load capacitance is either one of a liquid crystal display panel or an active-matrix liquid crystal display panel and an opposing electrode thereof being connected to a second end of said inductive element, or comprising an inductive element, and an analog switching circuit, a first end of said inductive element being grounded and a second end of which being connected in series via said analog switching circuit to opposing electrodes of either one of the liquid crystal display panel or an active-matrix liquid crystal display panel thereby forming a series LC resonant circuit; and wherein an NMOS switching element and a PMOS switching element being provided between said opposing electrodes of said liquid crystal display panel and said first power source and between said opposing electrodes of said liquid crystal display panel and a second power source, which being different from said first power source, respectively, and wherein said method is characterized in that a signal waveform applied to data bus line of said liquid crystal display panel is driven so as to correspond to a pixel signal to be applied to said pixel electrode of said liquid crystal display panel, and in synchronization with the rising edge and falling edge of this signal waveform, the following four time periods are sequentially repeated, said time periods comprising a first time period in which, with both an NMOS switching element and a PMOS switching element in OFF condition, said analog switching circuit is turned ON for a period of time that is approximately ½ the period of a resonant frequency of the LC series resonant circuit formed by said inductive element, capacitance, and said liquid crystal panel, thereby transferring an electrical charge that was stored in said opposing electrodes of said liquid crystal panel to said inductive element, a second time period in which, with both said analog switching circuit and said PMOS switching element in OFF condition, said NMOS switching element is turned ON, a third time period during which, with both said NMOS switching element and said PMOS switching element in OFF condition said analog switching circuit is turned ON for a period of time that is approximately ½ the period of said resonant frequency, thereby transferring an electrical charge that was stored in said inductive element to said opposing electrodes of said liquid crystal panel, and a fourth time period during which, with both said analog switching circuit and said NMOS switching element in OFF condition, said PMOS switching element is turned ON, the sequential repeating of said time periods performing AC voltage drive of said opposing electrodes, this performing sequential driving (scan line inversion driving) of scan lines and data bus lines of said liquid crystal display panel so that the polarity of the voltage applied to said pixel electrode with respect to said electrode is reversed for each neighboring scan line.

25. A driving method for driving a load capacitance drive circuit, according to claim 24, wherein scanning is performed of the scanning line signal applied to said scanning lines, skipping one or more lines on each scan, so that a plurality of frames forms one screen.

26. A driving method for driving a load capacitance drive circuit, said load capacitance drive circuit comprising, an active-matrix liquid crystal display panel and a pair of load capacitance driving circuit units each of which comprises a capacitance, an analog switching circuit, and an inductive element, a first end of said capacitance being grounded and a second end of which being connected in series via said analog switching circuit to a first end of said inductive element, while a part of said active-matrix liquid crystal display panel is connected to a second end of said inductive element, thereby forming a series LC resonant circuit; and wherein an NMOS switching element and a PHOS switching element being provided between said second end of said inductive element and said first power source and between said second end of said inductive element and a second power source, which being different from said first power source, respectively, and wherein said load capacitance is said active-matrix liquid crystal display panel, and further wherein, in said active-matrix liquid crystal display panel, an opposing electrode being divided into a plurality of strip like opposing electrodes by patterning said opposing electrode in parallel with said data bus lines into at least two groups, a first electrode group being formed by joining every other line of the patterned opposing electrodes and set to the same potential, while a second electrode group being formed by joining every other line of the patterned opposing electrodes other than those of said first electrode group to set them to the same potential, and said circuit further is characterized in that said first opposing electrodes group are connected to a second end terminal of said inductive element of a first load capacitance drive circuit unit, while said second opposing electrodes group are connected to said second end terminal of said inductive element of a second load capacitance drive circuit unit, and wherein said method is characterized in that said first load capacitance drive circuit unit and said second load capacitance drive circuit unit being driven in opposite phase by a driving circuit operation method in that a signal waveform applied to a data bus line on a first substrate of said liquid crystal display panel is driven so as to correspond to a pixel signal to be applied to a pixel electrode of said liquid crystal display panel, and in synchronization with the rising edge and falling edge of this signal waveform, the following four time periods are sequentially repeated, said time periods comprising a first time period in which, with both an NMOS switching element and a PMOS switching element in OFF condition, said analog switching circuit is turned ON for a period of time that is approximately ½ the period of a resonant frequency of the LC series resonant circuit formed by said inductive element, capacitance, and said liquid crystal panel, thereby transferring an electrical charge that was stored in said opposing electrodes of said liquid crystal panel to said inductive element, a second time period in which, with both said analog switching circuit and said PMOS switching element in OFF condition, said NMOS switching element is turned ON, a third time period during which, with both said NMOS switching element and said PMOS switching element in OFF condition said analog switching circuit is turned ON for a period of time that is approximately ½ the period of said resonant frequency, thereby transferring an electrical charge that was stored in said inductive element to said opposing electrodes of said liquid crystal panel, and a fourth time period during which, with both said analog switching circuit and said NMOS switching element in OFF condition, said PMOS switching element is turned ON, the sequential repeating of said time periods performing AC voltage drive of said opposing electrodes, this performing sequential driving (scan line inversion driving) of said scan lines and said data bus lines so that the polarity of the voltage applied to said pixel electrode with respect to said electrode is reversed for each neighboring scan line, said method is further characterized in that said first load capacitance driving circuit unit and said second load capacitance driving circuit unit are driven by dot reversal driving, in that said first load capacitance driving circuit unit and said second load capacitance driving circuit unit being driven in opposite phases by the driving method, wherein in said first and said second load capacitance driving circuit units, in synchronization with a rise of the signal waveform applied to said analog switching circuit, said signal waveform applied to said data bus line on said first substrate is driven in correspondence to a pixel signal to be applied to said pixel electrode, this performing sequential driving of said scan lines and said data bus lines of said first substrate so that the polarity of a voltage applied to said pixel electrode with respect to said electrode is reversed for each neighboring pixel electrode.

27. A driving method for driving a load capacitance drive circuit, said load capacitance drive circuit comprising, a first part of an active-matrix liquid crystal display panel, an analog switching circuit, an inductive element, and a second part of said active-matrix liquid crystal display panel are serially connected to each other thereby forming a series LC resonant circuit; and wherein in said active-matrix liquid crystal display panel, an opposing electrode thereof being divided into a plurality of strip-like opposing electrodes by patterning said opposing electrode in parallel with said data bus lines into at least two groups, a first opposing electrodes group being formed by joining every other line of said patterned opposing electrodes and set to the same potential, while a second opposing electrodes group being formed by joining every other line of the patterned opposing electrodes other than those of said first opposing electrodes group to set them to the same potential, and said driving circuit is further characterized in that said first opposing electrodes group are connected to a second end terminal of said inductive element of said load capacitance drive circuit forming a first driving circuit, while said second opposing electrodes group are connected to a first end terminal of said inductive element of said load capacitance drive circuit via said analogy switching circuit and forming a second driving circuit, wherein a PMOS switching element being connected between said second end terminal of said inductive element and a positive drive voltage supply, an NMOS switching element being connected between said second end terminal of said inductive element and a ground terminal, a PMOS switching element being connected between one end of said analog switching circuit connected to said first end terminal of said inductive element and a positive drive voltage supply, and an NMOS switching element being connected between one end of said analog switching circuit connected to said first end terminal of said inductive element and a ground terminal, wherein said method is characterized in that said scan lines and said data bus lines of said active-matrix liquid crystal display panel are driven by said dot reversal driving method, while a first opposing electrode group potential and a second opposing electrode group potential being driven with opposite polarities, said driving operation being performed so that said PMOS switching element which is connected between said first opposing electrode group and said positive drive voltage supply and the NMOS switching element which is connected between said second opposing electrode group and said ground terminal are ON simultaneously, and further said NMOS switching element which is connected between said first opposing electrode group and the ground terminal and said PROS switching element which is connected between said second opposing electrode group and the positive drive voltage supply are ON simultaneously.

* * * * *